US009668054B2

(12) United States Patent
Barone et al.

(10) Patent No.: US 9,668,054 B2
(45) Date of Patent: May 30, 2017

(54) AUDIO ARCHITECTURE FOR A PORTABLE SPEAKER SYSTEM

(71) Applicant: Fugoo Corporation, Irvine, CA (US)

(72) Inventors: Frank Barone, Gilbert, AZ (US); Dennis Stone, Costa Mesa, CA (US)

(73) Assignee: FUGOO CORPORATION, Irvine, CA (US)

( * ) Notice: Subject to any disclaimer, the term of this patent is extended or adjusted under 35 U.S.C. 154(b) by 0 days.

(21) Appl. No.: 14/588,800

(22) Filed: Jan. 2, 2015

(65) Prior Publication Data

US 2015/0195653 A1 Jul. 9, 2015

Related U.S. Application Data

(60) Provisional application No. 61/923,575, filed on Jan. 3, 2014.

(51) Int. Cl.
*H04R 5/02* (2006.01)
*H04R 5/00* (2006.01)
(Continued)

(52) U.S. Cl.
CPC ..... *H04R 5/00* (2013.01); *H04R 1/26* (2013.01); *H04R 5/04* (2013.01); *H04R 2430/03* (2013.01)

(58) Field of Classification Search
CPC ... H04R 1/26; H04R 5/00; H04R 5/04; H04R 2430/03
(Continued)

(56) References Cited

U.S. PATENT DOCUMENTS 8,175,304 B1 * 5/2012 North ..... H04R 5/02 381/17
9,271,061 B1 2/2016 Amores
(Continued)

FOREIGN PATENT DOCUMENTS

JP 2008-028686 A 2/2008
WO WO 2011-011224 A1 1/2011
WO WO 2011011224 A1 * 1/2011 ..... G10L 13/00

OTHER PUBLICATIONS

International Search Report and Written Opinion in International Application No. PCT/US2015/010033 dated Apr. 16, 2015 in 18 pages.

(Continued)

*Primary Examiner* — Vivian Chin
*Assistant Examiner* — Ammar Hamid
(74) *Attorney, Agent, or Firm* — Knobbe, Martens, Olson & Bear, LLP

(57) ABSTRACT

In some embodiments, portable speakers can be small and lightweight and can communicate with one or more audio device over wired or wireless connections. In some embodiments, portable speakers achieve reduced complexity as compared to typical high fidelity systems (e.g., by including a reduced number of speaker drivers and amplifiers), while still maintaining high fidelity stereo audio playback, thereby achieving both portability and high quality audio capability. For instance, certain implementations of the speaker include two primary speakers disposed on opposing faces of the speaker enclosure (e.g., full or mid-range drivers) and two tweeters, also disposed on opposing faces. Primary speakers can be disposed on respective ends of the housing and each can output a different stereo channel. Each tweeter can be positioned on different face of the housing. The speaker
(Continued)

system according to some embodiments generates a mono high frequency signal to drive the tweeters.

20 Claims, 20 Drawing Sheets

(51) Int. Cl.
*H04R 1/26* (2006.01)
*H04R 5/04* (2006.01)
*H04R 1/02* (2006.01)

(58) Field of Classification Search
USPC ..... 381/300, 334
See application file for complete search history.

(56) References Cited

U.S. PATENT DOCUMENTS

| | | | | |
|---|---|---|---|---|
| 9,307,307 | B2 | 4/2016 | Florczak | |
| 2007/0258611 | A1 | 11/2007 | Li | |
| 2007/0286426 | A1 | 12/2007 | Xiang et al. | |
| 2008/0140415 | A1 | 6/2008 | Shostak | |
| 2008/0174570 | A1 | 7/2008 | Jobs | |
| 2009/0190766 | A1* | 7/2009 | Klayman | H04S 3/002 381/18 |
| 2011/0085668 | A1* | 4/2011 | Larsen | H04R 3/14 381/1 |
| 2012/0213397 | A1 | 8/2012 | Crotts | |
| 2012/0224698 | A1 | 9/2012 | Yang | |
| 2013/0177165 | A1 | 7/2013 | Oishi | |
| 2013/0188821 | A1 | 7/2013 | Schul | |
| 2014/0219489 | A1* | 8/2014 | Waldman | H04R 1/34 381/334 |
| 2014/0355797 | A1* | 12/2014 | North | H04S 5/00 381/307 |
| 2015/0195633 | A1 | 7/2015 | Elsasser et al. | |
| 2015/0195652 | A1 | 7/2015 | Barone et al. | |

OTHER PUBLICATIONS

International Search Report and Written Opinion for International Application No. PCT/US2014/072839 dated Apr. 16, 2015 in 15 pages.

* cited by examiner

AUDIO ARCHITECTURE FOR A PORTABLE SPEAKER SYSTEM

CROSS-REFERENCE TO RELATED APPLICATIONS

This application claims the benefit under 35 U.S.C. §119(e) to U.S. Patent Application No. 61/923,575, filed on Jan. 3, 2014, which is incorporated by reference in its entirety.

BACKGROUND

Loudspeakers produce sound in response to an electrical audio input signal. Loudspeakers are available in different sizes. Large loudspeakers can be used, for example, in theaters, sports venues, and concerts. Small loudspeakers can be used, for example, in consumer electronic devices, such as televisions, laptops, tablets, and cellular phones. Recently, portable loudspeakers have become available. Such portable loudspeakers provide convenience to a listener as they can be moved around indoors or used outdoors. However, small dimensions of portable loudspeakers pose numerous challenges, such as problems with reproduction of high fidelity sound, power consumption, vibration, and the like. Accordingly, it is desirable to provide portable loudspeakers that address these and other challenges.

SUMMARY

In some embodiments, a portable speaker system can include a housing having first and second opposing ends, a bottom side, and first and second opposing sides, the first and second ends defining a width of the housing. The bottom, first, and second sides can each extend along a length of the housing between the first end and the second end to define a speaker enclosure. The speaker enclosure can have length greater than the width. The speaker system can also include first and second tweeters supported by the housing, the first tweeter arranged on the first side and the second tweeter arranged on the second side, opposing the first tweeter. The speaker system can also include first and second primary speakers supported by the housing, the first primary speaker arranged on the first end and the second primary speaker arranged on the second end, opposing the first primary speaker. The speaker system can also include an input interface configured to receive a stereo audio signal from an audio source, the stereo audio signal including left and right channels. The speaker system can also include audio mixing electronics disposed within the speaker enclosure and configured to receive the stereo audio signal from the input interface. The audio mixing electronics can include a mixer stage and a driver stage. The mixer stage can be configured to process the stereo audio signal to obtain a high frequency stereo component and a lower frequency stereo component, and obtain a mono component by combining left and right channels of the high frequency stereo component. The driver stage can include one or more audio amplifier circuits. The driver stage can be configured to output at least the mono component to the first and second tweeters and at least the lower frequency stereo component to the first and second primary speakers such that the first primary speaker outputs a left channel of the lower frequency stereo component, the second primary speaker outputs the right channel of the lower frequency stereo component, and the first and second tweeters both output the mono component.

The speaker system of the preceding paragraph may also include any combination of the following features described in this paragraph, among others described herein. In some embodiments, the input interface is configured to wirelessly receive the stereo audio signal from the audio source. The input interface can be configured to wirelessly receive the stereo audio signal from the audio source via a Bluetooth protocol. In certain embodiments, the audio mixing electronics can be configured to obtain the mono component by summing the left and right channels of the high frequency stereo component. In various embodiments, the high frequency stereo component includes frequencies higher than about 8-10 kHz. In various embodiments, the audio mixing electronics is also configured to combine the mono component and the lower frequency stereo component into a combined audio signal, and the driver stage is also configured to output the combined audio signal to the first and second tweeters and the first and second primary speakers. The combined audio signal can include the mono component on the right and left channels.

The speaker system described above may also include any combination of the following features described in this paragraph, among others described herein. In some embodiments, the one or more audio amplifier circuits can be connected to the audio mixing electronics via an Inter-IC Sound (I2S) bus. The one or more audio amplifier circuits can include first and second mono amplifiers, which can be mono class-D audio amplifiers. In various embodiments, the audio mixing electronics includes a digital signal processor (DSP). In certain embodiments, the speaker system includes first and second passive radiator speakers supported by the housing. The first passive radiator speaker can be arranged on the first side adjacent the first tweeter and the second passive radiator speaker can be arranged on the second side adjacent the second tweeter, the second passive radiator speaker opposing the first passive radiator speaker.

In some embodiments, a portable speaker system includes a housing having first and second opposing ends, a bottom side, and first and second opposing sides. The first and second ends can define a width of the housing, the bottom, first, and second sides each can extend along a length of the housing between the first end and the second end to define a speaker enclosure. The speaker system can also include first and second tweeters supported by the housing, the first tweeter arranged on the first side and the second tweeter arranged on the second side. The speaker system can also include first and second primary speakers supported by the housing, the first primary speaker arranged on the first end and the second primary speaker arranged on the second end.

The speaker system of the preceding paragraph may also include any combination of the following features described in this paragraph, among others described herein. In some embodiments, the speaker system can include at least one low frequency speaker configured to reproduce low frequency audio. The at least one low frequency speaker can include a first low frequency speaker arranged on the first side and the second low frequency speaker arranged on the second side. The first low frequency speaker can be arranged adjacent the first tweeter and the second low frequency speaker can be arranged adjacent the second tweeter. The first and second low frequency speakers can be positioned substantially symmetrically on the opposite first and second sides. The first and second low frequency speakers can be first and second passive radiator speakers. The first and second low frequency speakers can be first and second woofers. In certain embodiments, the speaker system can also include audio mixing electronics disposed within the speaker enclosure. The audio mixing electronics can be configured to receive a stereo audio signal and determine a modified stereo audio signal, and output, using at least one audio amplifier, the modified stereo audio signal to the first and second tweeters and the first and second primary speakers. The modified stereo signal output to the first and second tweeters can include a high frequency mono component. The audio mixing electronics can be configured to receive the stereo audio signal from an audio source. The audio mixing electronics can be configured to wirelessly receive the stereo audio signal from the audio source. The first and second tweeters can be positioned substantially symmetrically on the opposite first and second sides. The first side may not include any other tweeter in addition to the first tweeter and the second sides may not include any other tweeter in addition to the second tweeter. The first and second primary speakers can be positioned substantially symmetrically on the opposite first and second ends.

In some embodiments, a portable speaker system includes a housing having first and second opposing ends, a bottom side, and first and second opposing sides. The first and second ends can define a width of the housing, the bottom, first, and second sides each can extend along a length of the housing between the first end and the second end to define a speaker enclosure. The speaker system can also include first and second tweeters supported by the housing, the first tweeter arranged on the first side and the second tweeter arranged on the second side. The speaker system can also include first and second primary speakers supported by the housing, the first primary speaker arranged on the first end and the second primary speaker arranged on the second end. The first side does not include another tweeter in addition to the first tweeter, and the second side does not include another tweeter in addition to the second tweeter.

The speaker system of the preceding paragraph may also include any combination of the following features described in this paragraph, among others described herein. In some embodiments, the portable speaker system includes a first low frequency speaker arranged on the first side and the second low frequency speaker arranged on the second side. The first low frequency speaker can be arranged adjacent the first tweeter, and the second low frequency speaker can be arranged adjacent the second tweeter. The portable speaker can include audio mixing electronics disposed within the speaker enclosure. The audio mixing electronics can be configured to receive a stereo audio signal and determine a modified stereo audio signal, and output, using at least one audio amplifier, the modified stereo audio signal to the first and second tweeters and the first and second primary speakers. The modified stereo signal output to the first and second tweeters can include a high frequency mono component.

In some embodiments, a portable speaker system includes a housing having a plurality of speaker drivers and audio mixing electronics disposed within the housing. The audio mixing electronics can be configured to receive a stereo audio signal having left and right channels. The audio mixing electronics can also be configured to process the stereo audio signal to obtain a high frequency stereo component and a lower frequency stereo component, obtain a mono component by combining left and right channels of the high frequency stereo component, and reproduce the stereo audio signal by outputting the mono component and the lower frequency stereo component to the plurality of speaker drivers.

The speaker system of the preceding paragraph may also include any combination of the following features described in this paragraph, among others described herein. In some embodiments, the plurality of speaker drivers includes first and second primary speakers arranged on opposing ends of the housing. In various embodiments, the plurality of speaker drivers also includes first and second tweeters arranged on opposing sides of the housing. In certain embodiments, the plurality of speaker drivers also includes first and second low frequency speakers arranged on opposing sides of the housing, the first low frequency speaker arranged adjacent the first tweeter and the second low frequency speaker arranged adjacent the second tweeter. The first and second low frequency speakers can include first and second passive radiator speakers. In some embodiments, the audio mixing electronics is also configured to obtain the mono component by summing the left and right channels of the high frequency stereo component. The high frequency stereo component can include frequencies higher than about 8-10 kHz. In various embodiments, the audio mixing electronics is configured to wirelessly receive a stereo audio signal from an audio source. In certain embodiments, the audio mixing electronics is also configured to combine the mono component and the lower frequency stereo component into a combined audio signal and output the combined audio signal to each of the plurality of speaker drivers. The combined audio signal can include the mono component on the right and left channels. In various embodiments, the audio mixing electronics includes at least one audio amplifier connected to the plurality of speaker drivers.

In some embodiments, a method of reproducing audio includes receiving a stereo audio signal from an audio source, processing the stereo audio signal to obtain a high frequency stereo component and a lower frequency stereo component, obtaining a mono component by combining left and right channels of the high frequency stereo component, and reproducing the stereo audio signal by outputting the mono component and the lower frequency stereo component to a plurality of speaker drivers. The stereo audio signal can have left and right channels The method of the preceding paragraph may also include any combination of the following features described in this paragraph, among others described herein. In some embodiments, obtaining the mono component includes summing the left and right channels of the high frequency stereo component. In various embodiments, the method also includes generating a modified stereo audio signal by combining the lower frequency stereo component with the mono component and outputting the modified stereo audio signal to the plurality of speaker drivers. In certain embodiments, receiving the stereo audio signal includes wirelessly receiving the stereo audio signal from the audio source. In some embodiments, the high frequency stereo component includes frequencies higher than about 8-10 kHz. In certain embodiments, the method includes amplifying at least one of the mono component and the lower frequency stereo component.

DETAILED DESCRIPTION

Overview

Generally described, the present disclosure is directed to configurable sound systems, such as portable loudspeakers or speakers. Although various aspects of the disclosure will be described with regard to examples and embodiments, one skilled in the art will appreciate that the disclosed embodiments and examples should not be construed as limiting.

Embodiments of disclosed portable speakers provide convenience to a listener as they can be moved around indoors or used outdoors. In some embodiments, portable speakers can be small and lightweight. Portable speakers can communicate with one or more audio devices over wired or wireless connections, such as Bluetooth, Wi-Fi, Wireless Speaker and Audio (WiSA), and the like. Disclosed portable speaker embodiments can output or reproduce high quality and fidelity stereo audio, while maintaining low energy consumption. For example, a portable speaker can be capable of continuous playback of 10 or more hours.

In some embodiments, portable speakers achieve reduced complexity as compared to typical high fidelity systems (e.g., by including a reduced number of speaker drivers and amplifiers), while still maintaining high fidelity stereo audio playback, thereby achieving both portability and high quality audio capability. For instance, certain implementations of the speaker include two primary speakers disposed on opposing faces of the speaker enclosure (e.g., full or mid-range drivers) and two tweeters, also disposed on opposing faces. Primary speakers can be disposed on respective ends of the housing, for example, and each output a different stereo channel. Each tweeter can be positioned on different face of the housing. Moreover, rather than driving the tweeters with left and right stereo, the speaker system according to some embodiments generates a mono high frequency signal to drive the tweeters.

Embodiments of disclosed portable speakers can be enclosed in interchangeable enclosures (or "jackets"). Jackets can protect a portable speaker from potential damage resulting from moving the speaker, which can be moved around indoors or used outdoors. In some embodiments, jackets can be easily attached to the portable speaker and easily detached from the portable speaker. Jackets can provide aesthetic appeal and protect the speaker from damage without negatively affecting the quality of audio output.

Speaker Systems

Figure 1A:
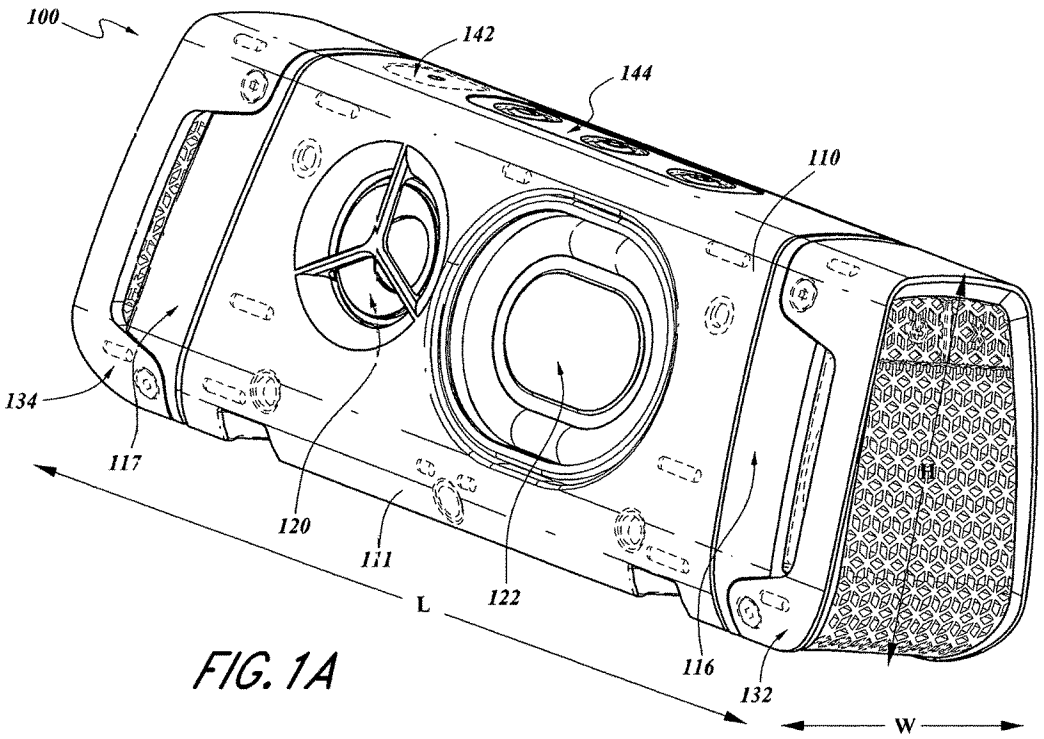
FIGS. 1A-1I illustrate a speaker system according to some embodiments.

FIG. 1A illustrates a perspective view of a speaker system 100 according to certain embodiments. The housing 110 includes an enclosure or housing 110, having a front face or side 111. The speaker system 100 also has a rear face or side 112 (illustrated in FIG. 1D), bottom side 114 (illustrated in FIG. 1B), top side 115 (illustrated in FIG. 1E), and right 116 (also illustrated in FIG. 1I) and left 117 sides or ends, which are covered by end caps 132 and 134. The illustrated speaker system 100 is shaped as a generally elongate box having a trapezoidal cross-section. This form factor can resist tip over when the speaker system 100 is placed on surfaces, providing improved stability. The trapezoidal form factor also accommodates the natural shape of the hand when gripped from the top (narrower side of trapezoid in palm), providing enhanced ergonomics as compared to some other form factors (e.g., purely rectangular form factors). In other embodiments, speakers of any suitable shapes fall within the scope of the disclosure, such as rectangular box, square box, cylindrical, spherical, conical, toroidal, pyramidal, and the like.

A speaker driver 120 is enclosed in or otherwise supported by the housing 110 and, as shown, is facing out on the front side 111. In some embodiments, the speaker driver 120 can be a tweeter configured to reproduce high frequency audio, such as, audio in the range of about 2 kHz to about 20 kHz (e.g., between about 6-20 kHz, 7-20 kHz, 8-20 kHz, 9-20 kHz, 10-20 kHz, and the like). The speaker driver 120 can be configured to reproduce high fidelity audio. In some embodiments, the speaker driver 120 can be a full-range speaker, mid-range speaker, low frequency speaker, etc. The speaker driver 120 is an active driver in the illustrated embodiment. In some embodiments, the speaker driver 120 is not used.

A speaker driver 122 is enclosed in or otherwise supported by the housing 110 and, as shown, is facing out on the front side 111. In some embodiments, the speaker driver 122 can be a low frequency speaker configured to reproduce low frequency audio or bass, such as, audio in the range of about 20 Hz to about 200 Hz. The speaker driver 122 can be passive. For instance, a passive speaker driver 122 is used, such as, a passive radiator speaker which may or may not include an active driver. In certain embodiments, a different passive driver 122 (e.g., a driver that does not include an actively driven component) is used, such as sealed or ported enclosure, a bass reflex system with one or more ports or vents, one or more reflex ports, and the like. The speaker driver 122 can be configured to reproduce high fidelity audio. In some embodiments, the speaker driver 122 can be a full-range speaker, mid-range speaker, tweeter, etc. In some embodiments, the speaker driver 122 is not used. In some other embodiments, the speaker driver 122 is an actively driven component.

In some embodiments, the housing 110 includes one or more input devices 142, such as a microphone, and one or more user controls 144. The controls 144 can be power on/off, volume up/down, and the like. In some embodiments, additional or different controls and input devices can be used and can be placed on different surfaces of the housing 110 or in different places on the surfaces. In some embodiments, input devices or controls are not used.

The speaker system 100 can be portable. In some embodiments, the length L of the speaker system 100 can be about 6.5 inches (approximately 165.2 mm). The depth or width W of the speaker system 100 can be about 1.7 inches (approximately 43.5 mm), and the height H of the speaker system 100 can be about 2.3 inches (about 58.8 mm). In certain embodiments, the speaker system 100 is less than about 12 inches long, less than about 4 inches wide, and less than about 5 inches tall. In some embodiments, the speaker system 100 can be longer or shorter than about 6.5 inches, wider or thinner than about 1.7 inches, and taller or shorter than about 2.3 inches. For example, the speaker system 100 can be about 11.2 inches long (approximately 284 mm), about 3.4 inches wide (approximately 85.7 mm), and about 3.9 inches tall (about 98.6 mm). In certain embodiments, the speaker system 100 is less than about 24 inches long, less than about 8 inches wide, and less than about 10 inches tall.

While maintaining portability, the speaker system 100 can also generate audio output having a desired fidelity and loudness in part by being large enough to support a speaker driver architecture capable of providing such fidelity and loudness. For instance, the speaker system 100 can be large enough to support an arrangement of speaker drivers such as is shown and described with respect to FIGS. 1A-1E or with respect to any of the other embodiments provided herein. Moreover, the speaker system 100 can be large enough such that the housing 110 defines an interior cavity having a sufficient volume to provide a desired acoustic affect. Along these lines, certain embodiments of the speaker system 100 including any of those in the preceding paragraph are at least about 1 inch wide, at least about 4 inches long, and at least about 1.5 inches tall. In further embodiments, including any of those in the preceding paragraph, the speaker system 100 is at least about 0.75 inches wide, at least about 3.5 inches long, and at least about 1.0 inch tall. In yet additional embodiments, again including any of those in the preceding paragraph, the speaker system 100 is at least about 1.5 inches wide, at least about 5 inches long, and at least about 2 inches tall.

Figure 1B:
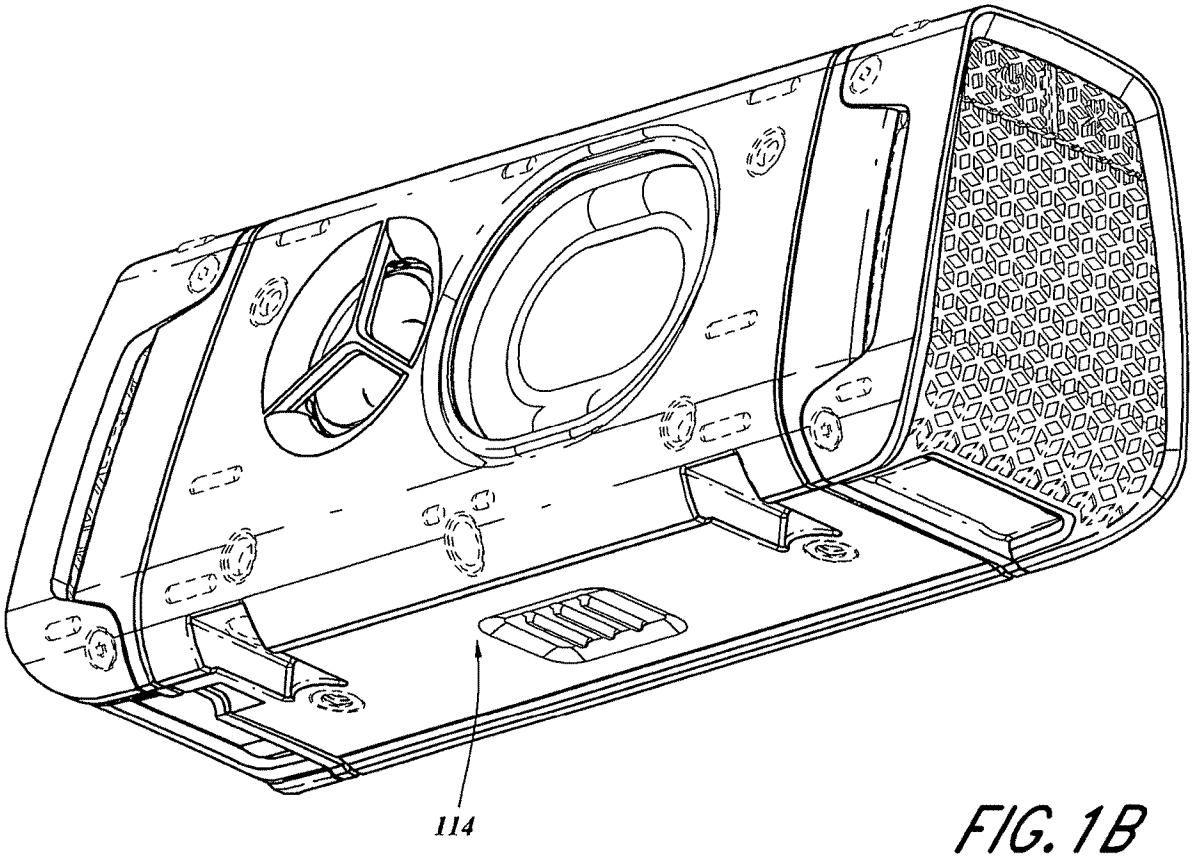
Figure 1C:
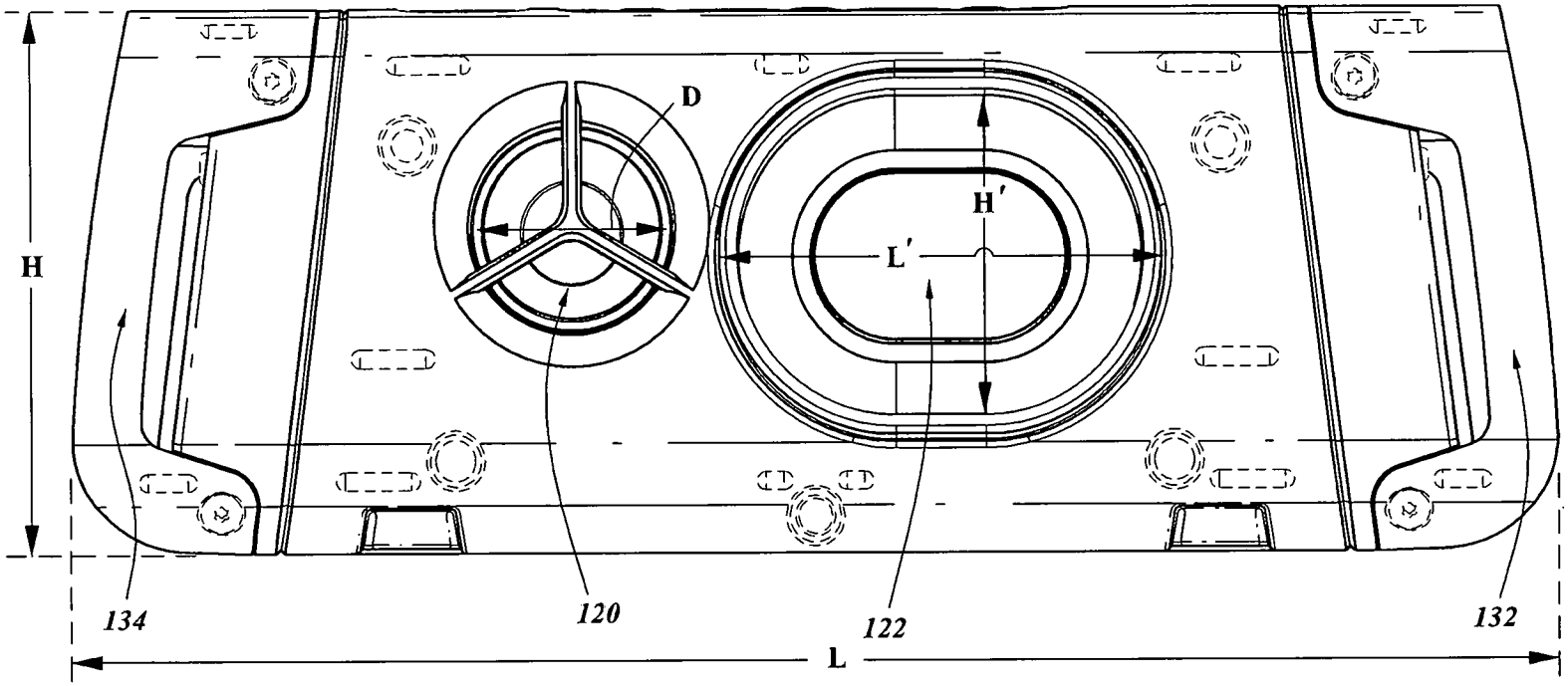

FIG. 1B illustrates another perspective view of the speaker system 100. The bottom side 114 of the housing 110 is shown in FIG. 1B. FIG. 1C illustrates a front view of the speaker system 100, with the front face or side shown as 111.

Figure 1D:
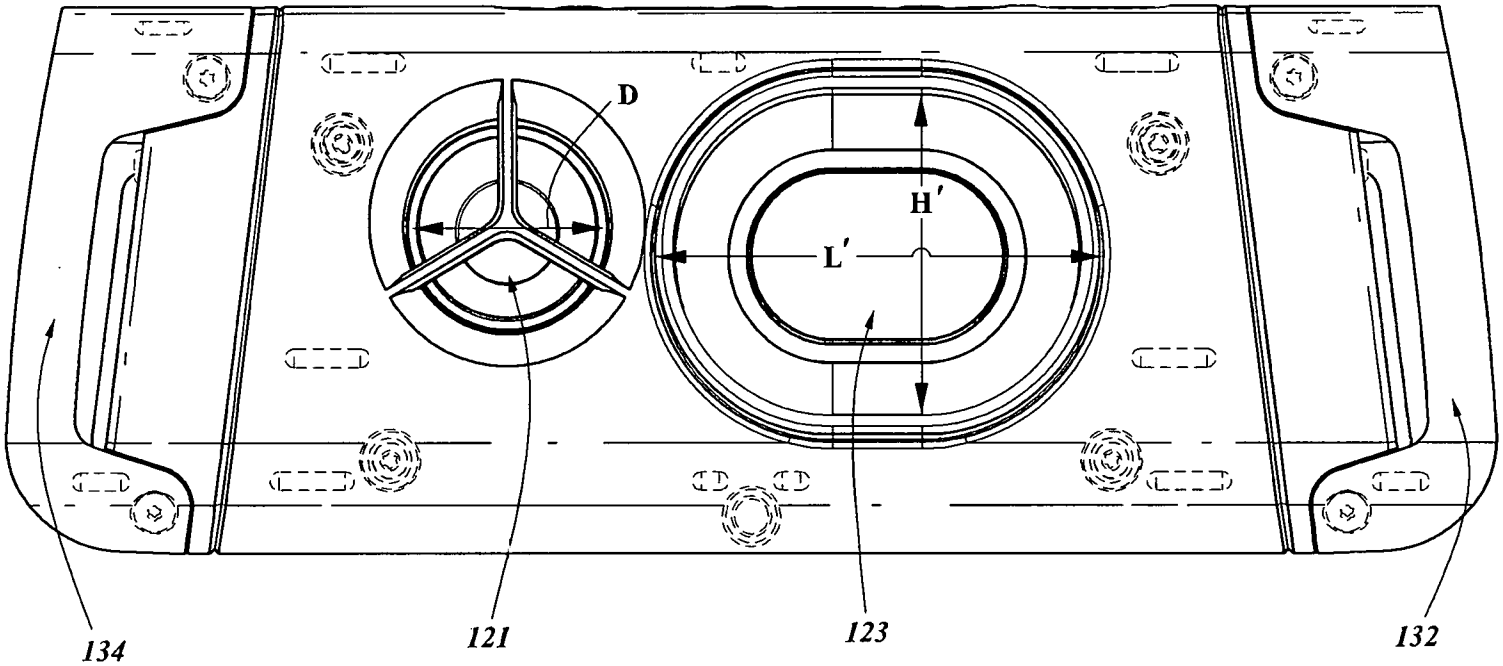

FIG. 1D illustrates a rear view of the speaker system 100. The rear or back side 112 of the housing 110 is shown in FIG. 1D. A speaker driver 121 is enclosed in or otherwise supported by the housing 110 and, as shown, is facing out on the rear side or face 112. In some embodiments, the speaker driver 121 can be a tweeter configured to reproduce high frequency audio, such as, audio in the range of about 2 kHz to about 20 kHz (e.g., between about 6-20 kHz, 7-20 kHz, 8-20 kHz, 9-20 kHz, 10-20 kHz, and the like). The speaker driver 121 can be configured to reproduce high fidelity audio. In some embodiments, the speaker driver 121 can be a full-range speaker, mid-range speaker, low frequency speaker, etc. The speaker driver 121 is an active driver in the illustrated embodiment. In some other cases, the speaker driver 120 is a passive component. In some embodiments, the speaker driver 121 is not used.

In the illustrated embodiment, the speaker driver 120 (and 121) is a tweeter having a diameter D of about 1.1 inches (approximately 28 mm). In various embodiments, the diameter D of the speaker driver 120 (and 121) is at least about 0.5 inches, at least about 0.75 inches, or at least about 1 inch. In some embodiments, the diameter of the speaker driver 120 (and 121) can be smaller than 0.5 inches or greater than about 1.1 inches. The depth of the speaker driver 120 (and 121) can be selected to correspond to the depth of the speaker system 100. For example, the depth of the speaker driver 120 (and 121) can be less than about 1.7 inches. As another example, the depth of the speaker driver 120 (and 121) can be less than about 4 inches.

A speaker driver 123 is enclosed in or otherwise supported by the housing 110 and, as shown, is facing out on the rear side 112. In some embodiments, the speaker driver 123 can be a low frequency speaker configured to reproduce low frequency audio or bass, such as, audio in the range of about 20 Hz to about 200 Hz. The speaker driver 123 can be passive. For instance, a passive speaker driver 123 is used, such as, a passive radiator speaker which may or may not include an active driver. In certain embodiments, a different passive driver 123 is used, such as sealed or ported enclosure. The speaker driver 123 can be configured to reproduce high fidelity audio. In some embodiments, the speaker driver 123 can be a full-range speaker, mid-range speaker, tweeter, etc. In some embodiments, the speaker driver 123 is not used. In some other embodiments, the speaker driver 123 is an actively driven component.

Figure 1E:
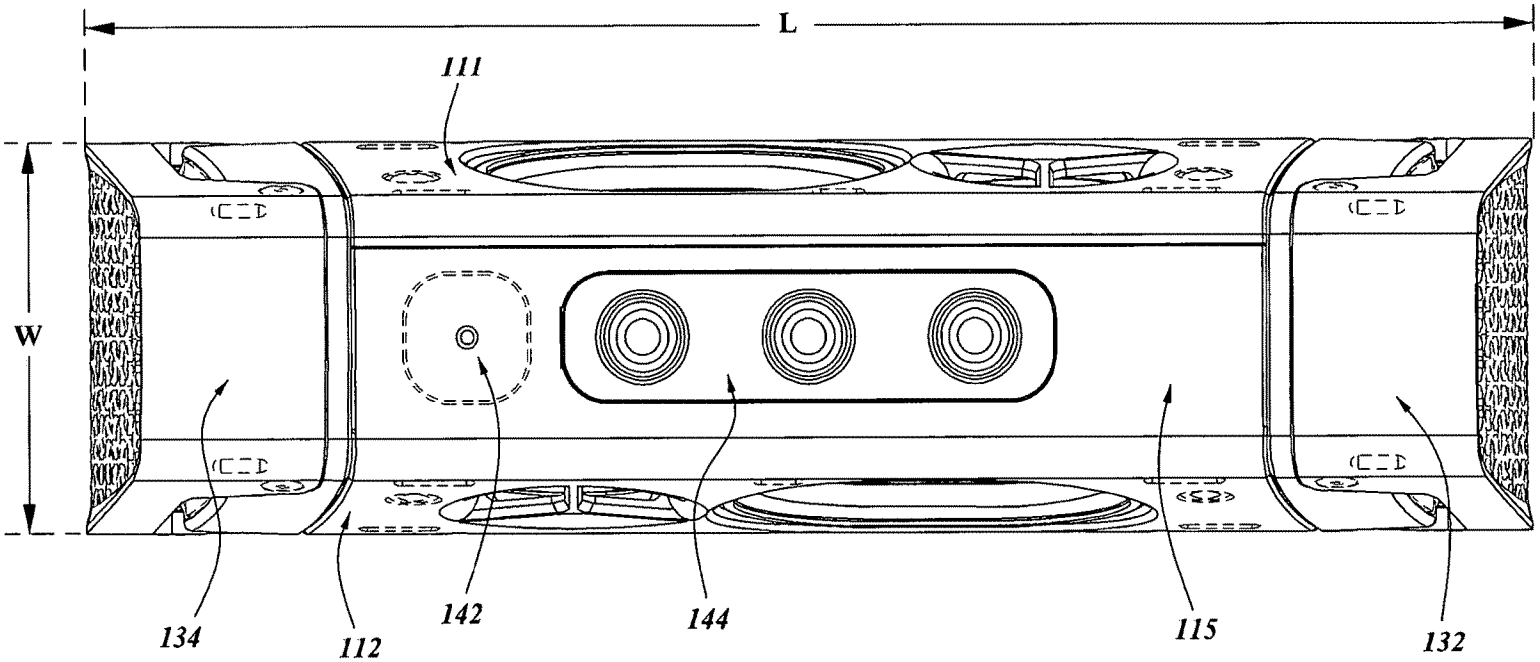
Figure 1F:
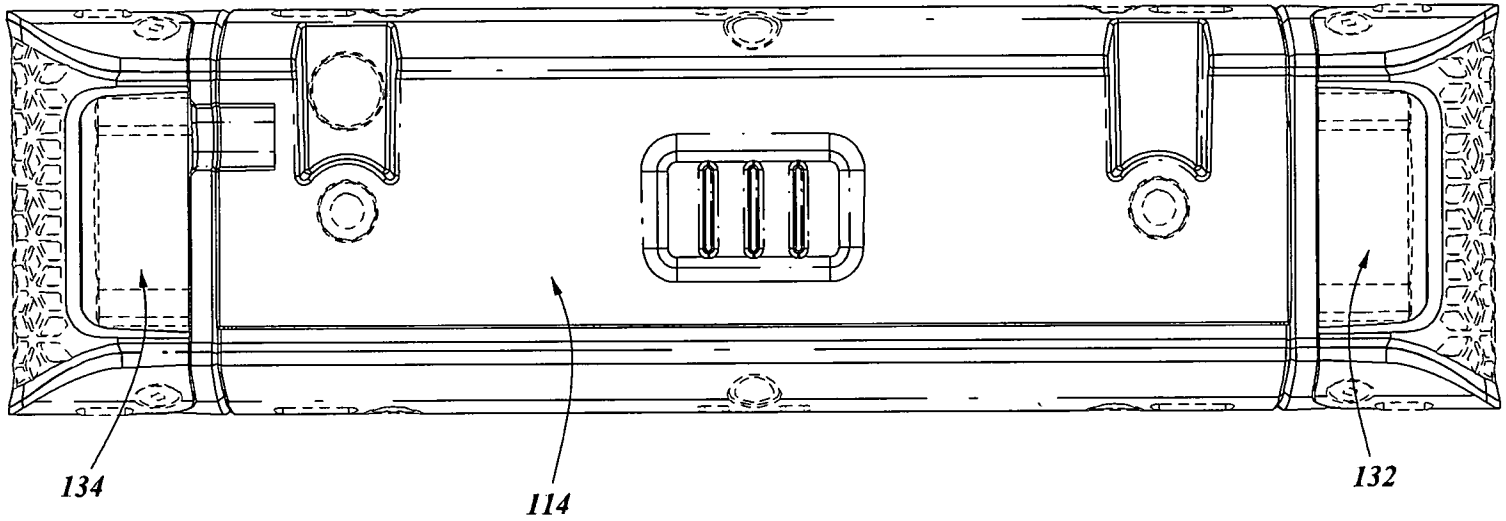

In the illustrated embodiment, the speaker driver 122 (and 123) is a passive radiator for generating relatively low frequency output and having a length L' of about 2.1 inches (approximately 54 mm) and a height H' of about 1.7 inches (approximately 43 mm). In various embodiments, the speaker driver 122 (and 123) can have a length L' of greater than about 1.0 inches, greater than about 1.5 inches, or greater than about 1.75 inches long, and a height H' of greater than about 0.75 inches, greater than about 1.0 inches, or greater than about 1.5 inches. In some embodiments, the length L' of the speaker driver 122 (and 123) can be smaller than about 1.0 inches or greater than about 2.1 inches and the height H' can be smaller than about 0.75 inches or greater than about 1.7 inches. In certain embodiments, for example, the speaker driver 122 (and 123) can be about 4.0 inches long (approximately 101.2 mm) and about 2.4 inches high (approximately 61.2 mm). The depth of the speaker driver 122 (and 123) can be selected to correspond to the depth of the speaker system 100. For example, the depth of the speaker driver 122 (and 123) can be less than about 1.7 inches. As another example, the depth of the speaker driver 122 (and 123) can be less than about 4 inches FIG. 1E illustrates a top view of the speaker system 100. The top side 115 of the housing 110 is shown in FIG. 1E. FIG. 1F illustrates a bottom view of the speaker system 100. The bottom side 114 of the housing 110 is shown in FIG. 1F.

Figure 1H:
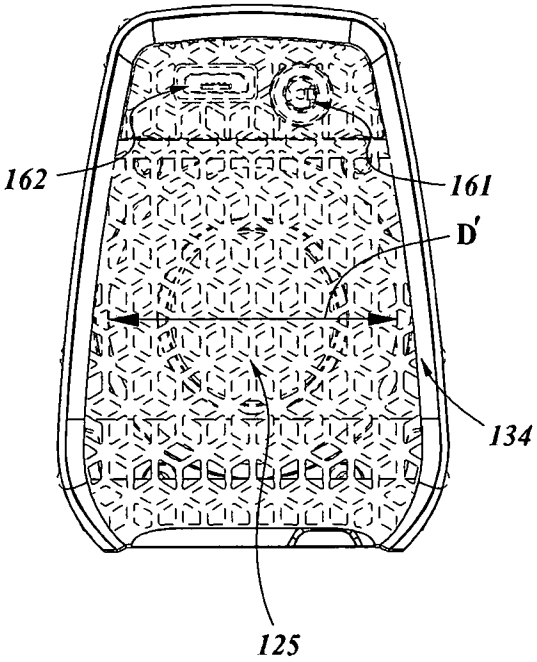
Figure 1G:
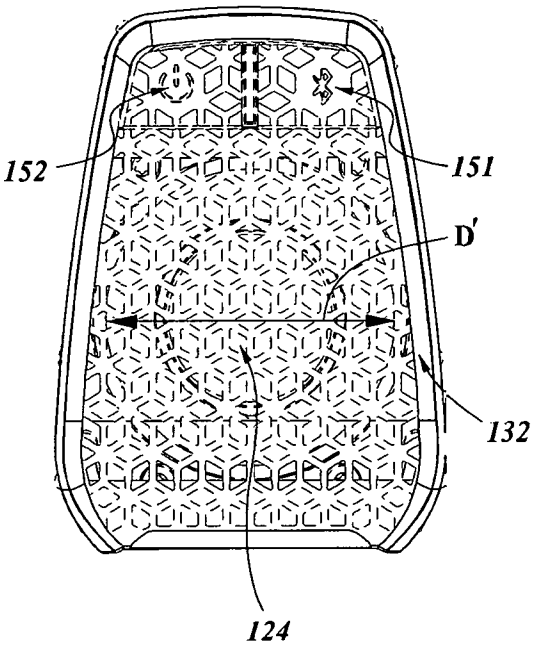

FIG. 1G illustrates a side view of the speaker system 100. As is illustrated, a speaker driver 124 is covered by the end cap 132. In some embodiments, the end cap 132 is removable. The speaker driver 124 is enclosed in or otherwise supported by the housing 110 and, as shown, is facing out on the right side 116 (covered by the end cap 132). In some embodiments including the illustrated embodiment, the speaker driver 124 can be a primary speaker configured to reproduce full-range audio, such as, audio in the range of about 20 Hz to about 20 kHz. The speaker driver 124 can be configured to reproduce high fidelity audio. In other embodiments, the speaker driver 124 is a mid-range speaker configured to reproduce middle frequencies, such as, audio in the range of about 300 Hz to about 5 kHz. In yet further embodiments, the speaker driver 124 can be a tweeter or low frequency speaker, etc. The illustrated speaker driver 124 is an actively driven component, although a passive component can be used in other embodiments. In some embodiments, one or more passive components (e.g., low frequency passive components are provided on the ends in addition to the speaker driver 124. In some embodiments, the speaker driver 124 is not used.

In some embodiments, one or more input devices and indicators are positioned on the side 116 or in the end cap 132. As is illustrated, an indicator 151 is positioned in the housing on the side 116 and is visible through the end cap 132. The indicator 151 provides visual indication of connectivity to an audio source (e.g., Bluetooth connectivity). An indicator 152 is positioned in the housing on the side 116 and is visible through the end cap 132. The indicator 152 provides visual indication of whether the speaker system 100 is powered on or off. In some embodiments, additional or different indicators can be used and can be placed on different surfaces of the housing 110 or in different places on the surfaces. In some embodiments one or more indicators can be visual, audio, tactile, etc. In some embodiments, one or more indicators and input devices are not used.

FIG. 1H illustrates a side view of the speaker system 100. As is illustrated, a speaker driver 125 is covered by the end cap 134. In some embodiments, the end cap 134 is removable. The speaker driver 125 is enclosed in the housing 110 and, as shown, is facing out on the left side 117 (covered by the end cap 134). In some embodiments, the speaker driver

125 can be a primary speaker configured to reproduce full-range audio, such as, audio in the range of about 20 Hz to about 20 kHz. The speaker driver 125 can be configured to reproduce high fidelity audio. In other embodiments, the speaker driver 125 is a mid-range speaker configured to reproduce middle frequencies, such as, audio in the range of about 300 Hz to about 5 kHz. In yet further embodiments, the speaker driver 125 can be a tweeter or low frequency speaker, etc. The illustrated speaker driver 125 is an actively driven component, although a passive component can be used in other embodiments. In some embodiments, one or more passive components (e.g., low frequency passive components are provided on the ends in addition to the speaker driver 125. In some embodiments, the speaker driver 125 is not used.

In the illustrated embodiment, the speaker driver 124 (and 125) is a full range driver or woofer having a diameter D' of about 1.5 inches (approximately 39 mm). In various embodiments, the diameter D' of the speaker driver 124 (and 125) can be at least about 0.5 inches, at least about 0.75 inches, or at least about 1.0 inch. In some embodiments, the diameter D' of speaker driver 124 (and 125) can be smaller than 0.5 inches or greater than about 1.5 inches. In certain embodiments, for example, the diameter D' of the speaker driver 124 (and 125) can be about 2.4 inches (approximately 60 mm). The depth of the speaker driver 124 (and 125) can be selected to correspond to the depth of the speaker system 100. For example, the depth of the speaker driver 124 (and 125) can be less than about 1.7 inches. As another example, the depth of the speaker driver 124 (and 125) can be less than about 4 inches.

In some embodiments, one or more connectors are positioned on the side 114 or in the end cap 134. As is illustrated, a connector 161 is positioned in the housing on the side 117 and is accessible through the end cap 134. The connector 161 is an audio connector. A connector 162 is positioned in the housing on the side 117 and is accessible through the end cap 134. The connector 162 is a USB connector, which can provide access to memory of the speaker system 100 and allow for controlling the operation of the speaker system 100. For example, the connector 162 can be used to modify or upgrade the firmware or software being executed by electronics of the speaker. As another example, the connector 162 can be utilized to transmit audio stored on a storage device connected to the speaker system 100 via the connector 162. In some embodiments, additional or different connectors can be used and can be placed on different surfaces of the housing 110 or in different places on the surfaces. In some embodiments one or more connectors can be wired or wireless. In some embodiments, one or more connectors are not used.

Figure 1I:
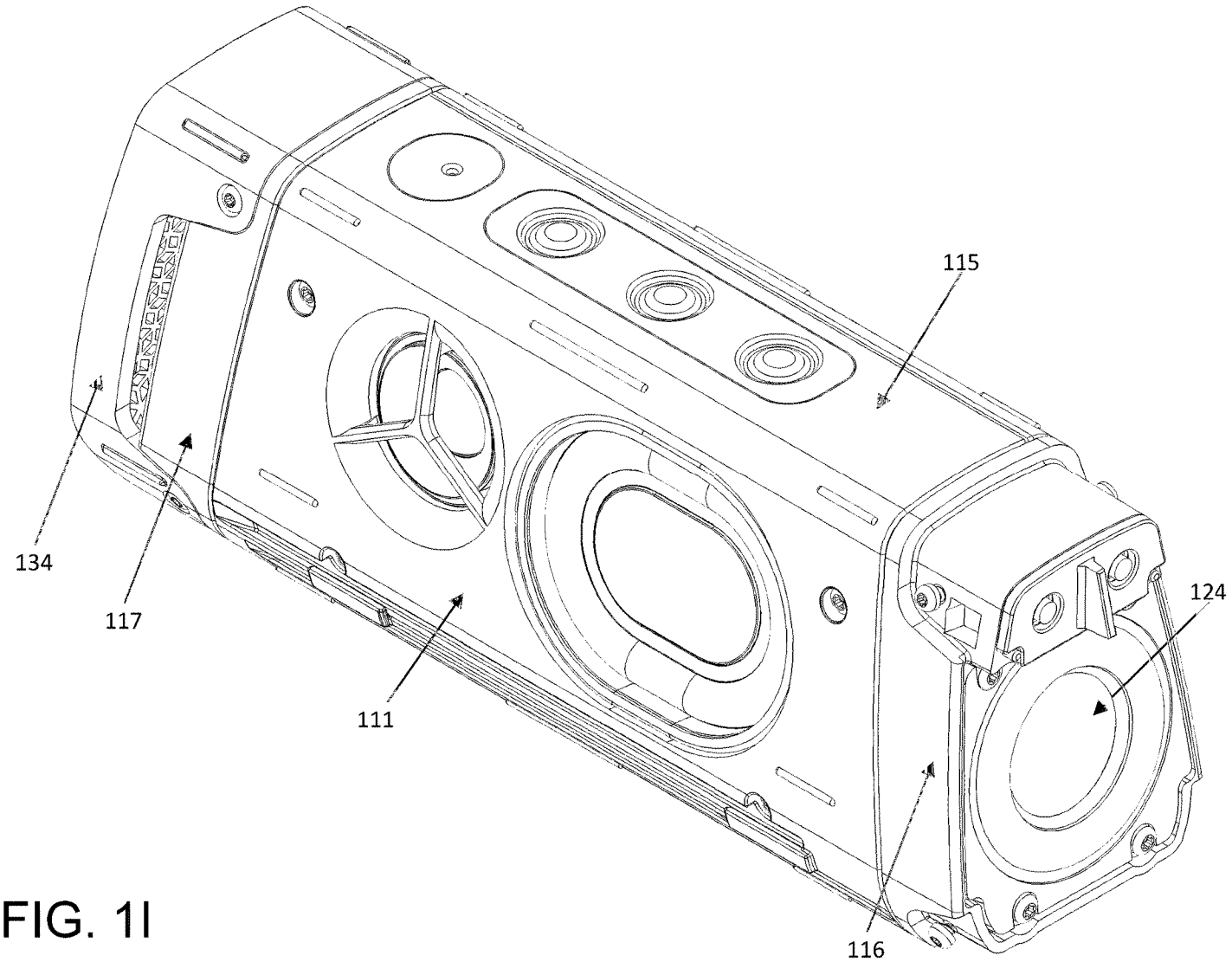

FIG. 1I illustrates a perspective view of the speaker system 100 with the side cap 132 removed exposing the right side 116 and the speaker driver 124. The side cap 134 can be similarly removed, which would expose the left side 117 and the speaker driver 125.

In some embodiments, the speaker system 100 can provide 360 degree surround sound. This can be achieved in the illustrated embodiment via positioning the primary speakers on the opposite ends of the speaker housing 110, tweeters on the opposite sides of the housing 110, and low frequency speakers on the opposite sides of the housing 110. For instance, given the relatively small size, and in particular the relatively small cross-sectional width of the portable enclosure 110, sound from the left and right audio channels emanating from the primary speakers can generally wrap around the enclosure. Thus, the primary speakers can output sound in substantially 360 degrees for some or all of the frequency content (e.g., depending on the frequency response of the primary speakers) with only a minimal number of primary speakers. In some embodiments, e.g., depending on the type of primary drivers, size of enclosure, etc., the degree of audio wrap around can be relatively greater for lower and mid-level frequencies (e.g., frequencies below about 8 kHz) than for higher frequencies. In such cases, the tweeters positioned on either side 111, 112 fill in the higher frequency sound, e.g., for listening areas that are normal to the sides 111, 112, thereby providing substantially 360 degree sound over low, mid, and high frequencies.

The illustrated speaker system 100 and speakers according to various embodiments described herein additionally achieve reduced complexity as compared to typical high fidelity systems, while still maintaining high fidelity stereo audio playback, achieving both portability and high quality audio capability. For instance, including a single tweeter on two opposing faces of the speaker system 100 reduces complexity as compared to a traditional stereo audio system, which would include left and right tweeters on each face. Moreover, outputting mono audio from each of the differently facing tweeters instead of stereo (left channel to one, right channel to the other) achieves a balanced high frequency audio effect, as compared to delivering a left high frequency component in one direction, and a right high frequency component in another direction. Reducing the number of drivers and associated componentry also allows for a greater acoustic volume within the speaker system 100.

In some embodiments, additional speaker drivers can be used or one or more speaker drivers can be omitted. For example, in certain embodiments, two tweeters can be positioned on each of the front and rear faces of the speaker system 100. A low frequency speaker can be positioned between the tweeter pairs arranged on each of the faces. In certain embodiments, one or more speaker drivers can be placed differently from the placement illustrated in FIGS. 1A-1I. For example, one or more speaker drivers can be placed on different surfaces of the housing or in different places on the surfaces. As another example, one or more speaker drivers can be positioned fully inside the housing. In some embodiments, the speaker system 100 is air tight or substantially air tight and waterproof or substantially waterproof.

In some embodiments, speaker driver pairs 120 and 121 can be placed symmetrically or substantially symmetrically, respectively, on the front 111 and rear 112 sides of the housing 110. Speaker driver pairs 122 and 123 can be placed symmetrically or substantially symmetrically, respectively, on the front 111 and rear 112 sides of the housing 110. Speaker driver pairs 124 and 125 can be placed symmetrically or substantially symmetrically, respectively, on the right 116 and left 117 sides of the housing 110. In some embodiments, the speaker system 100 does not produce substantially any vibration or produces low vibration even while playing back audio at high sound intensity (e.g., high volume). This can be achieved due to using a small number of speakers, as described above, and arranging the speakers in the enclosure as described above. Placing speakers of similar type in opposing orientations, such as on opposing sides facing in different directions, can limit or reduce overall vibration of the speaker system 100 because forces generated by opposing speakers are generally equal and opposite and tend to cancel. For example, substantially no vibration or low vibration can be achieved by symmetrical or substantially symmetrical arrangement of various pairs of speakers, such as primary speaker pairs, low frequency speaker pairs, tweeter pairs, etc. Reducing vibration can prevent undesired movement of the speaker system 100 due to vibration, improve user experience, etc.

Audio Processing

Figure 2:
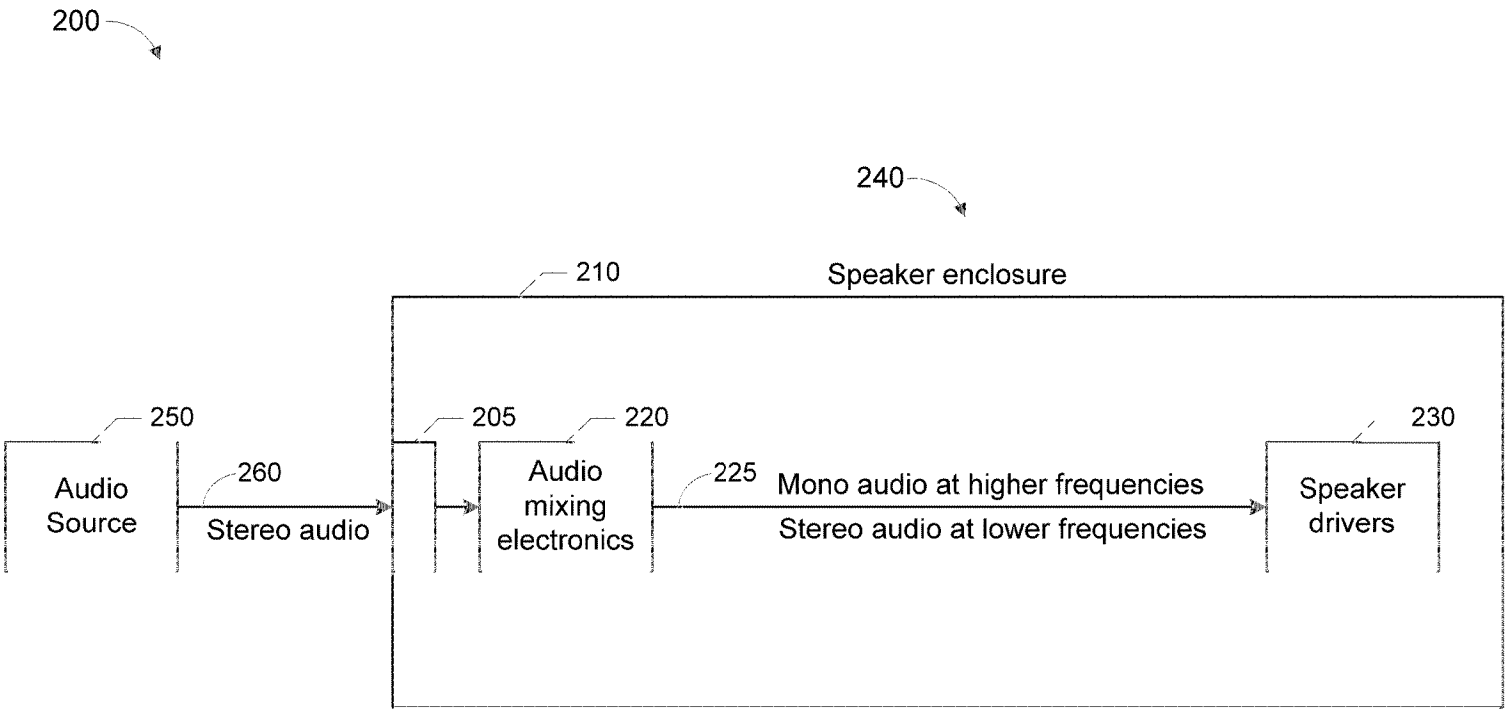
FIG. 2 illustrates an audio processing and reproduction system according to some embodiments.

FIG. 2 illustrates a block diagram of audio processing and reproduction system 200 according to some embodiments. An audio source 250 transmits stereo audio to a speaker 240 (which may be the speaker system 100). In some embodiments, the audio source 250 is a stationary or portable audio player that is separate from the speaker 240. For example, the audio source 250 can be a computer, laptop, tablet, cellular phone, smartphone, television, receiver, etc. The audio source 250 can be located near the speaker 240. In certain embodiments, the audio source 250 can be integrated with the speaker 240. In some embodiments, the audio source 250 is connected to the speaker 240 via a wired or wireless interface. For example, the audio source 250 can be connected to the speaker 240 via a Bluetooth interface. In some embodiments, the audio source 250 transmits analog stereo audio 260. In certain embodiments, the audio source 250 transmits audio in any suitable format, such as digital stereo audio, digital mono audio, analog mono audio, and the like. In some embodiments, stereo audio signal includes two channels or more than two channels.

The speaker 240 includes a speaker enclosure or housing 210. The housing 210 encloses and supports various components of the speaker, such as input interface 205, audio mixing electronics 220, and speaker drivers 230. The input interface 205 is configured to receive stereo audio 260 transmitted by the audio source 250. The input interface 205 can be wired or wireless, such as, a Bluetooth interface. Speaker drivers 230 can include one or more speaker drivers configured to output or reproduce audio in high quality. For example, as is illustrated in connection with the speaker system 100, speaker drivers 230 can include two primary speakers, two tweeters, and two passive radiator speakers. In some embodiments, some of the illustrated components can be omitted and other components can be added. For example, one or more memory modules can be part of the speaker 240.

In some embodiments, the audio mixing electronics 220 is configured to receive stereo audio 260 from the input interface 205, process the audio 260, and output the processed audio to the one or more speaker drivers 230. The audio mixing electronics 220 can include one or more electronic modules, such as, memory, a mixer stage configured to process the stereo audio signal, a driver stage configured to reproduce the processed audio signal by outputting the signal to the one or more speaker drivers 230. The audio mixing electronics 220 can include one or more logical circuit components, such as one or more controllers, microcontrollers, processors, microprocessors, digital signal processors (DSP), and the like. As explained in more details below, the audio mixing electronics 220 can process the audio signal 260 and produce a processed signal 225, such as a mono audio signal at higher frequencies and stereo audio signal at lower frequencies.

Figure 3A:
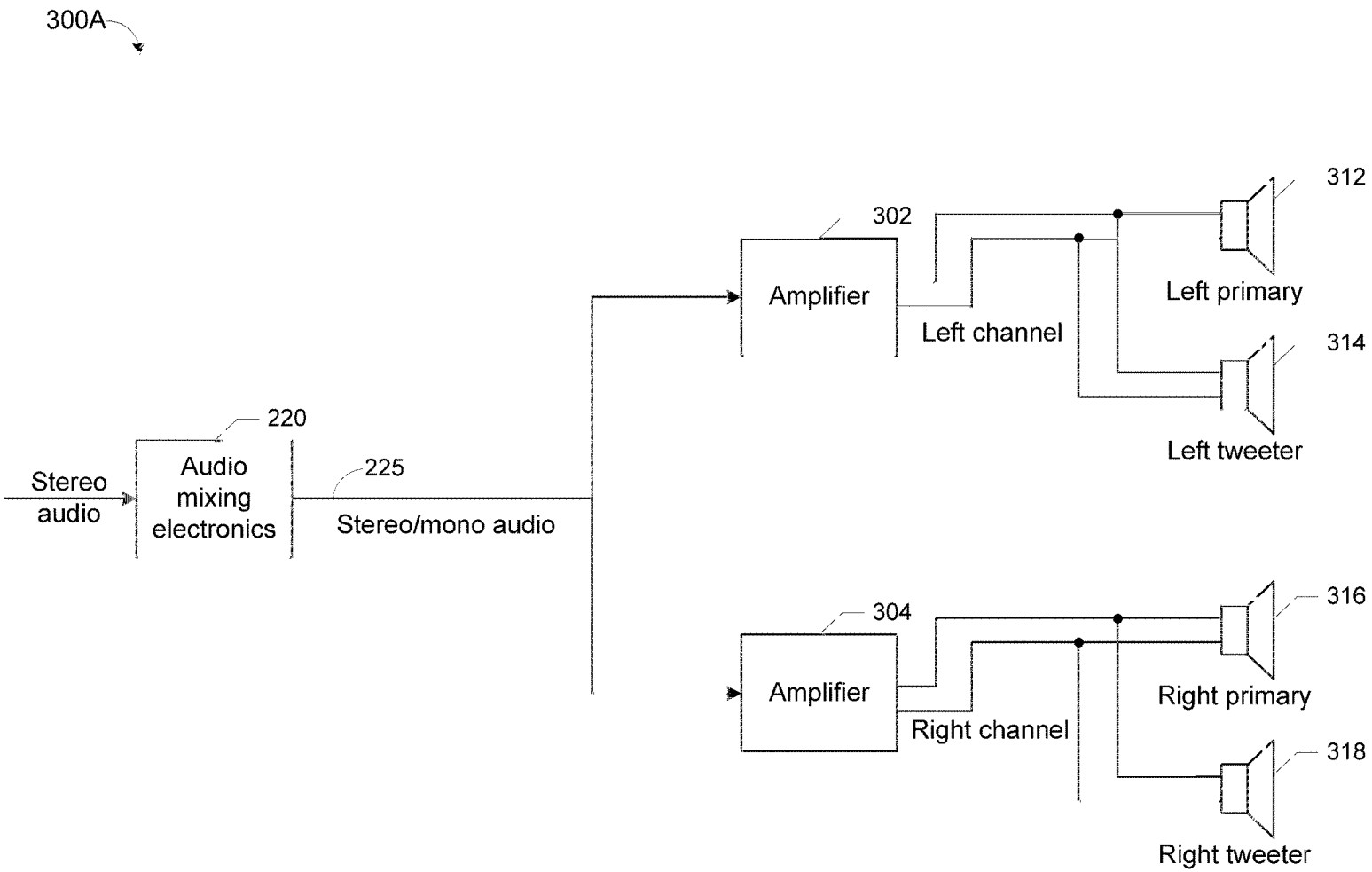
FIGS. 3A-3B illustrate audio processing and reproduction systems according to some embodiments.

FIG. 3A illustrates audio processing and reproduction system 300A according to some embodiments. The system 300A can be utilized by the speaker 240. The audio mixing electronics 220 processes the stereo audio signal 260 and produces a processed audio signal 225. In some embodiments, the system 300A reproduces stereo audio on channels 1 (left) and 2 (right), respectively, using left channel amplifier 302 and right channel amplifier 304. The left channel amplifier 302 is connected to and drives a left primary speaker 312 and a left tweeter 314. The right channel amplifier 304 is connected to and drives a right primary speaker 316 and a right tweeter 318. The amplifiers 302 and 304 can be audio amplifiers configured to suitably amplify the audio signal for playback by one or more speaker drivers. For example, the amplifiers 302 and 304 can be class D mono amplifiers. In some embodiments, any suitable amplifier can be used, such as Class A, Class B, Class AB, Class C, and the like.

In some embodiments, such as when the speaker utilizing the system 300A is a small, portable speaker system, the audio mixing electronics 220 can produce or generate a processed audio signal 225 that includes a mono audio signal at high frequencies and stereo audio signal at lower frequencies. For example, the mono audio signal at high frequencies can include frequencies above about 8 kHz, above about 9 kHz, above about 10 kHz, frequencies above a frequency from the range of about 8-10 kHz, and the like. The mono audio signal can be generated by combining the separate channels of the stereo audio signal 260. For example, the audio mixing electronics 220 can generate the mono audio signal by summing the left and right channels of the received stereo audio signal 260. In some embodiments, the audio mixing electronics 220 can generate the mono audio signal by combining the separate channels of the stereo audio signal 260 in any suitable linear or non-linear manner, such as by generating an average, scaled sum, median, root mean square (RMS), and the like. This process occurs in the digital domain in some embodiments including the illustrated embodiment, e.g., in a microprocessor included in the audio mixing electronics 220. In some other cases, some or all of the mono signal generation process occurs in the analog domain. The audio mixing electronics 220 can generate a stereo audio signal at lower frequencies by removing higher frequencies, which can be used for generating the high frequency mono signal, from the received stereo audio signal 260. In some embodiments, the audio mixing electronics 220 includes one or more analog or digital filters to separate the received stereo audio signal 260 into lower frequency and higher frequency components. For example, one or more single-stage or multiple-stage low pass and high pass filters can be used.

In some embodiments, particularly when a speaker is small and the speaker drivers are placed close to one another within the speaker housing, higher frequency audio components may be played back in mono rather than stereo without significant or noticeable degradation of sound quality. This can be so because a listener may not be able to discern or perceive stereo separation, localization, and other effects at higher frequencies. In some embodiments, the left and right tweeters 314 and 318 can be configured to reproduce or output higher frequency audio having same or substantially same frequency range as the high frequency mono audio signal generated by the audio mixing electronics. The left and right tweeters 314 and 318 can each output the high frequency mono audio signal. For example, the left and right tweeters 314 and 318 can each output the same high frequency mono audio signal. The left and right primary speakers 312 and 316 can be configured to reproduce or output lower frequency audio having the same or substantially same frequency range as the lower frequency stereo signal. The left and right primary speakers 312 and 316 can output the left and right channels of the lower frequency stereo audio signal.

In some embodiments, the primary speakers may not be configured to or be capable of reproducing some or all of the higher frequency audio components and the tweeters may not be configured to or capable of reproducing some or all of the lower frequency audio components. For example, the primary speakers may not be able to reproduce or accurately or audibly reproduce frequencies higher than a certain upper threshold frequency even when driven with an audio signal that includes frequency components above the upper threshold frequency. As another example, the tweeters may not be able to reproduce or accurately or audibly reproduce frequencies lower than a certain lower threshold frequency even when driven with an audio signal that includes frequency components below the lower threshold frequency. In some embodiments including the illustrated embodiment, the primary speakers are capable of reproducing audio at frequencies including some or all of those included in the high frequency mono signal. For simplicity, the audio mixing electronics 220 can generate a combined audio signal having high frequency mono components and lower frequency stereo components and provide the combined audio signal to the one or more amplifiers for playback by the tweeters and the primary speakers. Thus, the same output signal 225 can be used to drive both the primary speakers and the tweeters. Moreover, a single amplifier can be used for each channel, reducing complexity. The combined audio signal 225 can be generated by the audio mixing electronics 220 by (a) extracting the left and right high frequency components from the audio source signal 260, (b) combining those extracted high frequency components into a single mono high frequency component as described previously (e.g., by summing the left and right channels at the higher frequencies), and (c) combining (e.g., summing or combining in any other suitable linear or non-linear manner) the stereo signal for the lower frequencies with the newly generated mono signal for the higher frequencies to generate a combined (e.g., full bandwidth) signal including the high frequency mono component and lower frequency stereo components. This process occurs in the digital domain in some embodiments including the illustrated embodiment, e.g., in a microprocessor included in the audio mixing electronics 220. In some other cases, some or all of this process occurs in the analog domain. The combined audio signal can be suitably amplified, and the amplified combined audio signal can be fed to the tweeters and the primary speakers for playback.

Figure 3B:
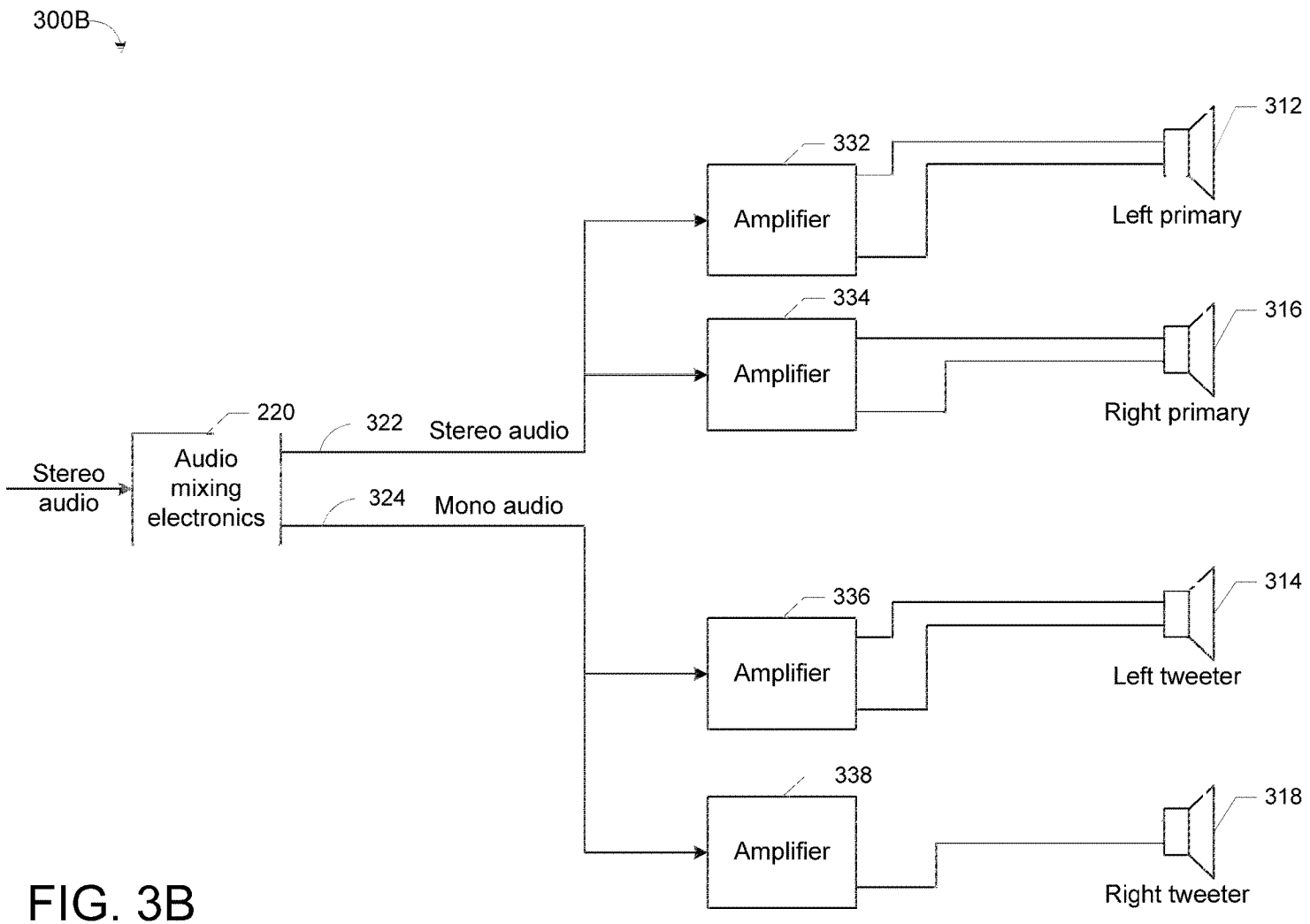

FIG. 3B illustrates audio processing and reproduction system 300B according to some embodiments. The system 300B can be utilized by the speaker 240. Unlike the system 300A of FIG. 3A where the audio mixing electronics 220 output a combined stereo/mono output 225 having both lower and high frequency components, the system 300B outputs separate stereo and mono outputs 322, 324. For instance, the audio mixing electronics 220 can be configured to generate a lower frequency stereo audio signal 322, which is output to amplifiers 332 and 334. The amplifiers 332 and 334 suitably amplify the lower frequency stereo audio signal and drive the left and right primary speakers 312 and 316, which reproduce lower frequency stereo audio. The audio mixing electronics 220 can also be configured to generate a high frequency mono audio signal 324, which is output to amplifiers 336 and 338. The amplifiers 336 and 338 suitably amplify the high frequency mono audio signal and drive the left and right tweeters 314 and 318, each of which reproduces high frequency mono audio. In some embodiments, two amplifiers can be used, one to drive the left and right primary speakers 312 and 316 and the other to drive the left and right tweeters 314 and 318.

In some embodiments, the audio reproduction systems 200, 300A, and 300B can utilize one or more low frequency speakers to provide high quality bass playback. For example, as described above in connection with the speaker system 100, one or more passive radiator speakers can be utilized, which may or may not include an active driver. One or more primary speakers can serve as a driver for the one or passive radiators. In certain embodiments, a passive radiator speaker includes a sealed volume that responds to low frequency audio by reinforcing the audio at desired levels. The passive radiator speaker can operate by mass variations changing the way the speaker's compliance interacts with motion of the air in the sealed volume. In some embodiments, one or more actively driven low frequency speakers can be used.

Referring again to FIG. 2, in some embodiments, the audio mixing electronics 220 can be configured to process the received audio signal 260 to produce different or additional components, or to drive additional speakers. For example, the audio mixing electronics 220 can produce low frequency audio components for playback by one or more low frequency speakers in addition to the primary speakers and the tweeters. In some embodiments, some amplifiers illustrated in FIGS. 3A-3B can be omitted and additional amplifiers can be added. One or more amplifiers can be connected to one or more speaker drivers in any suitable manner. In some embodiments, the audio mixing electronics 220 can generate a high frequency stereo (not mono) signal by processing (e.g., filtering) the received audio signal 260. The high frequency stereo audio signal can be output to the one or more amplifiers, which drive one or more speaker drivers, such as tweeters, configured to reproduce or playback higher frequency audio. In certain embodiments, the audio mixing electronics 220 can provide additional processing, such as, linear and non-linear equalization of the audio signal. Non-linear equalization can include amplifying or boosting lower frequency (or bass) audio components at lower sound intensity levels (e.g., lower volume settings). As the sound intensity level is increased, the amplification of bass components can be reduced. Non-linear equalization can enhance the quality of sound playback by boosting bass components without loss of output sound intensity.

Figure 4:
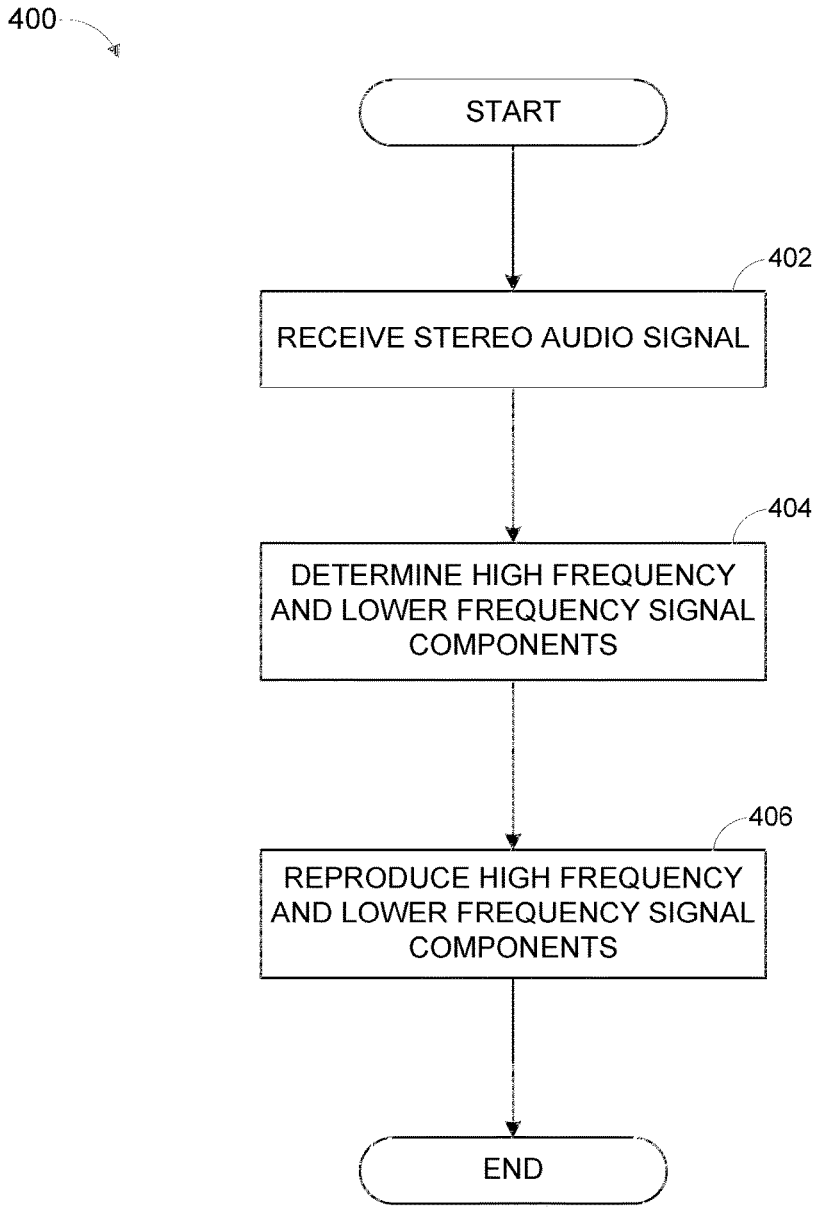
FIG. 4 illustrates an audio processing and reproduction process according to some embodiments.

FIG. 4 illustrates an audio processing and reproduction process 400 according to some embodiments. The process 400 can be implemented by the audio mixing electronics 220 alone or in combination with the input interface 205. In block 402, the process 400 receives a stereo signal (or any other suitably formatted signal) from an audio source, such as the audio source 250. In block 404, the process 400 separates the received audio signal into one or more components, such as high frequency audio components and lower frequency audio components. As explained above, the high frequency components can be mono audio components derived by the audio mixing electronics 220 from a high frequency stereo input, and the lower frequency components can be stereo components. In block 406, the process 400 reproduces or plays back the one or more audio components on one or more speaker drivers.

Figures 5, 5A:
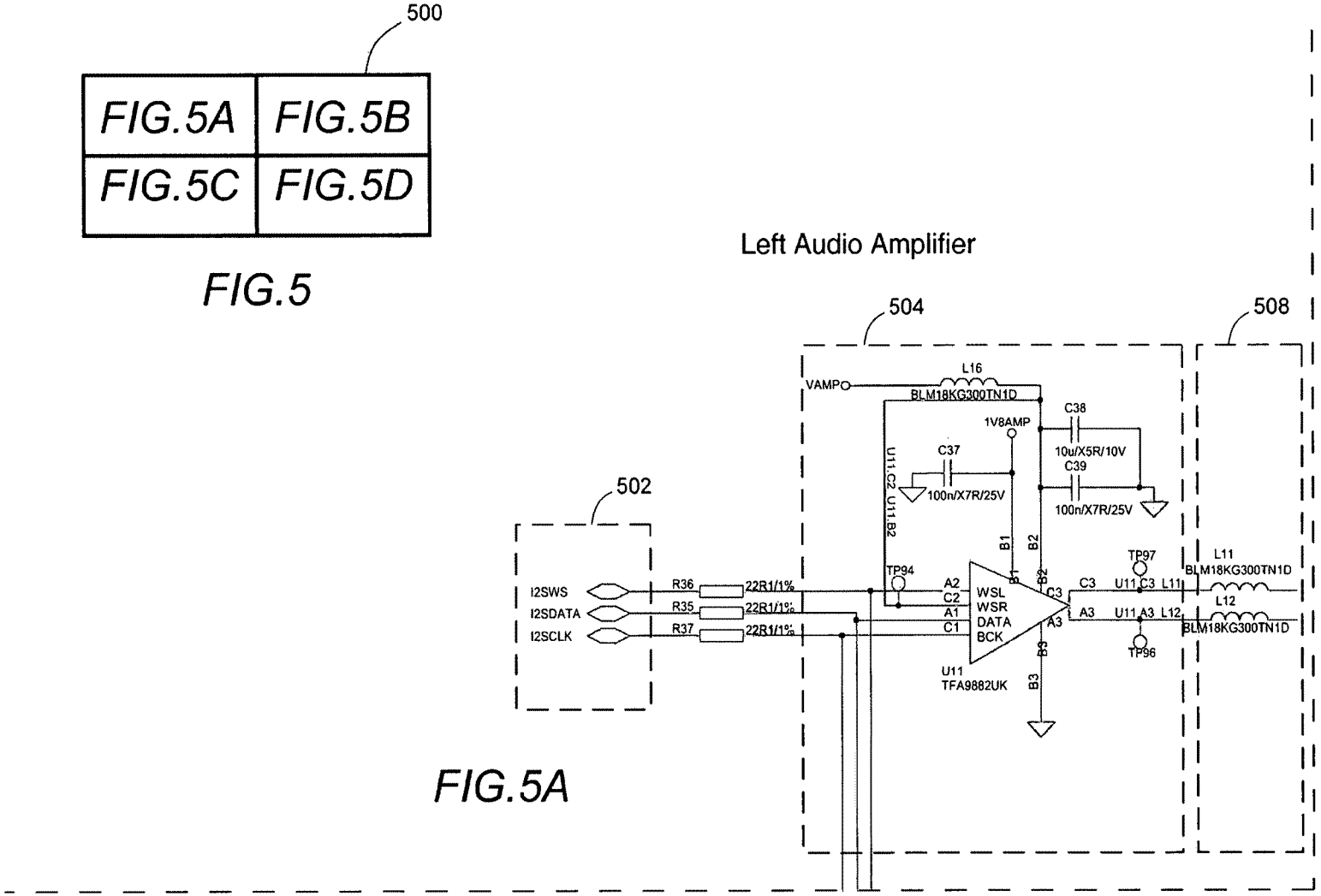
FIG. 5 illustrates a schematic of audio processing and reproduction system according to some embodiments.
Figure 5B:
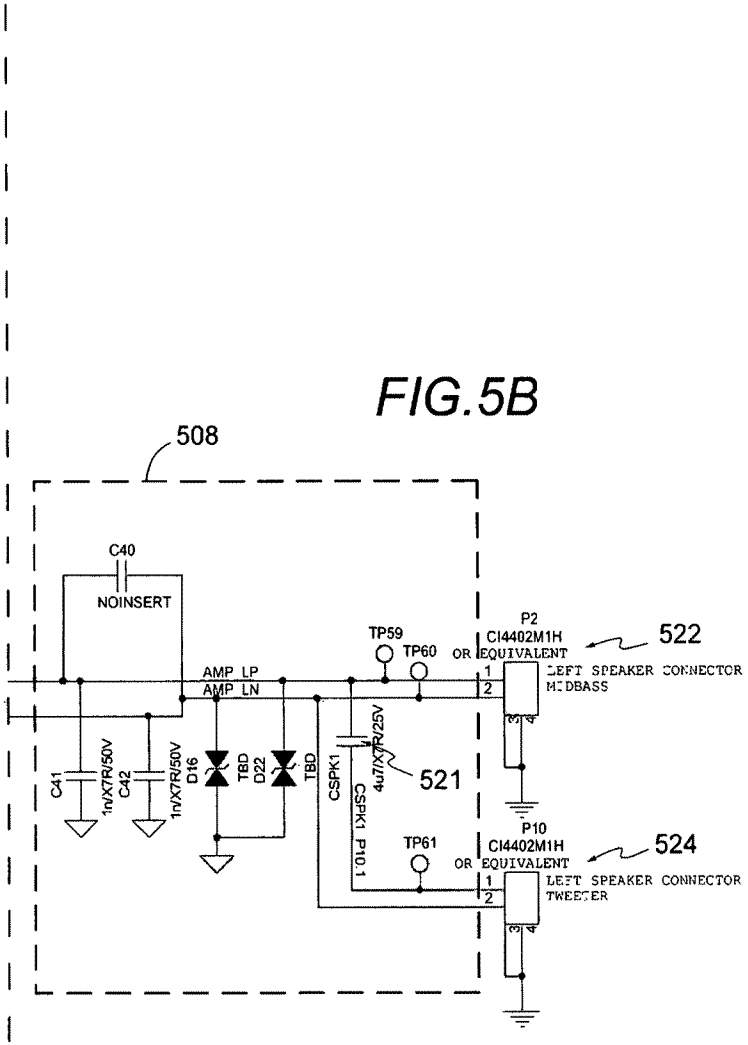
Figure 5C:
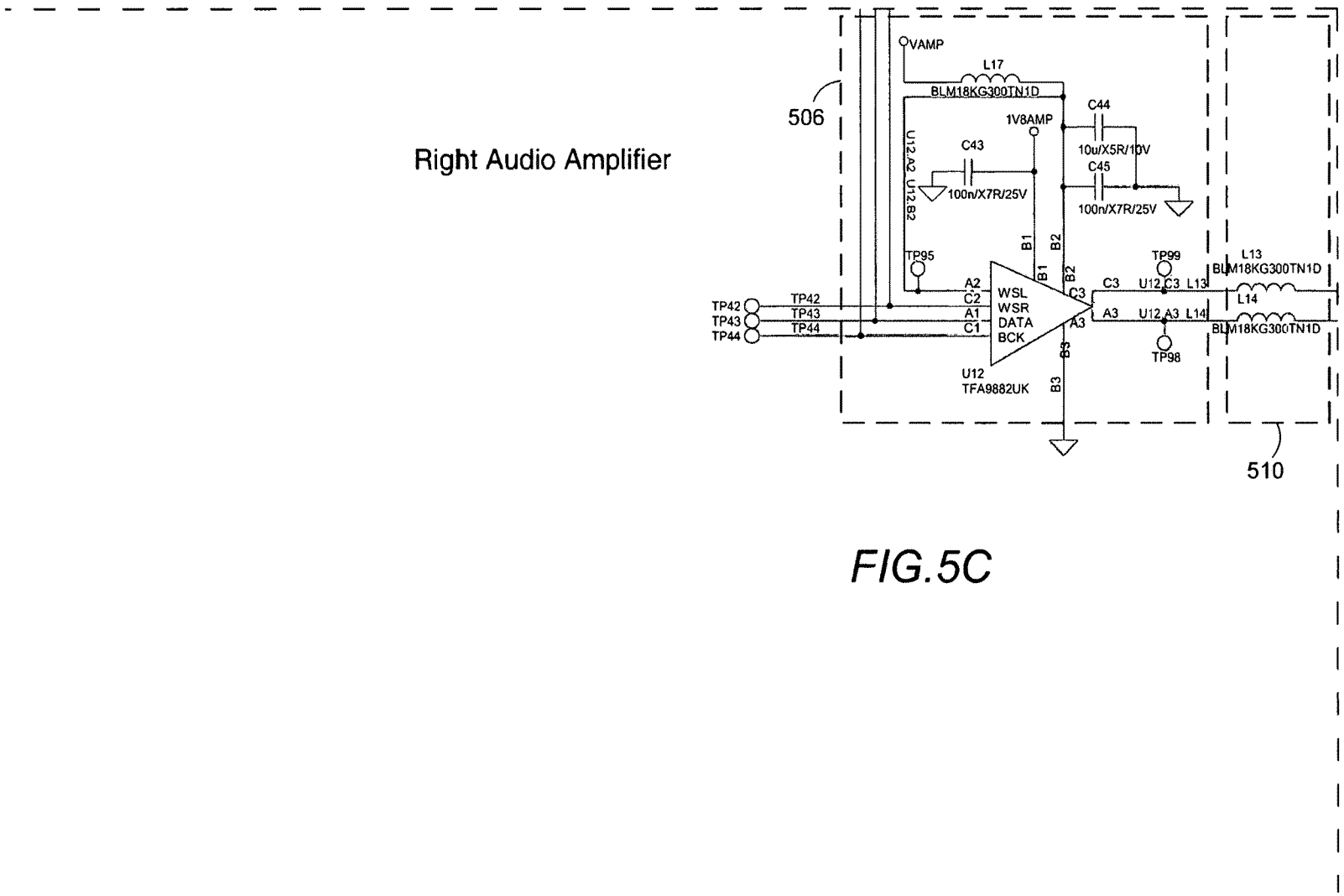
Figure 5D:
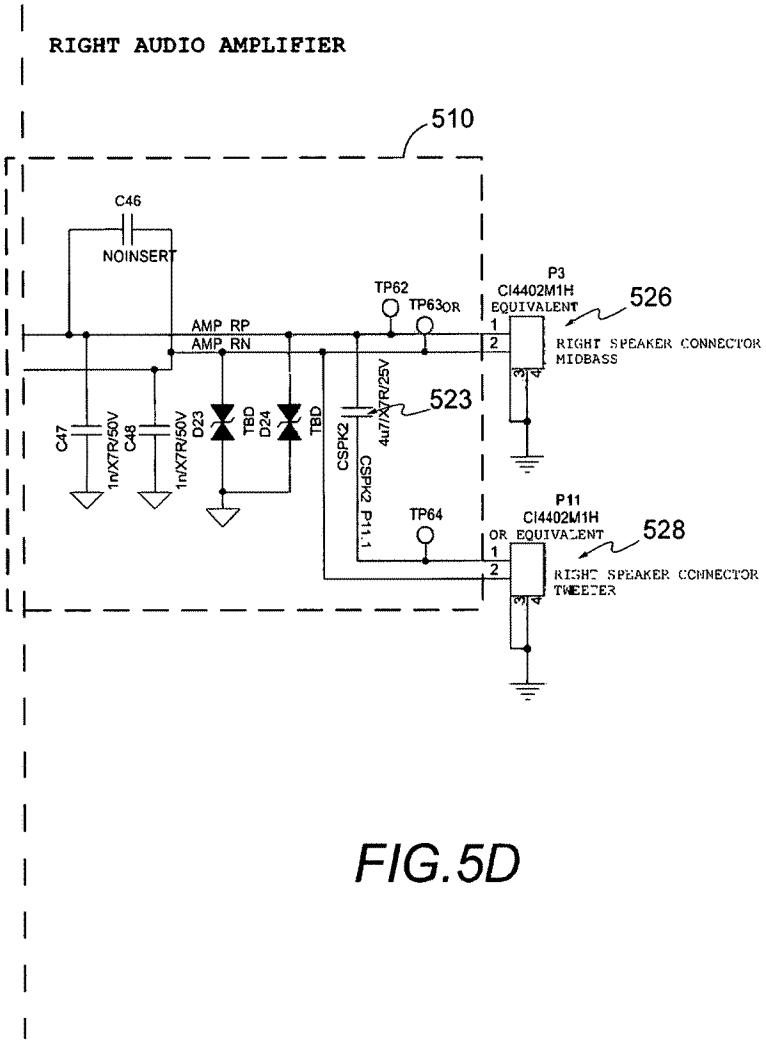

FIG. 5 illustrates a schematic of audio processing and reproduction system 500 according to some embodiments. The schematic 500 can be utilized by the systems 200, 300A, and 300B. In some embodiments, the received audio signal 260 can be digitized by the audio mixing electronics 220 and formatted according to Inter-IC Sound (I2S) interface. The I2S interface or bus uses pulse-code modulation (PCM) to serially transmit audio data between devices. The I2S interface separates clock and serial data signals, which can result in a lower jitter than communication interfaces that recover the clock signal from the data stream. The I2S interface includes three bus lines: continuous serial clock line (CLK), multiplexed data line (DATA), which includes stereo audio data on multiple channels, and word select line (WS) configured to indicate the channel being transmitted. For example, WS=0 can correspond to channel 1 (left), and WS=1 can correspond to channel 2 (right). Serial data (DATA) can be transmitted in two's complement format with the most significant bit (MSB) being transmitted first, since the receiver and transmitter can have different word length. When the word lengths of the receiver and transmitter do not match, the transmitted data can be truncated (when the receiver word length is shorter) or padded with additional zero bits (when the receiver word length is longer). Further details of the I2S interface specification are provided in "I2S bus specification," available at https://sparkfun.com/datasheets/BreakoutBoards/I2SBUS.pdf, which is incorporated by reference in its entirety.

With reference to FIGS. 2, 3A and 5, processed audio data 225 is formatted as I2S bus audio signal 502, having a word select line (I2SWS), serial multiplexed data line (I2SDATA), and serial clock line (I2SCLK). Processing and formatting of the received audio data 260 into processed audio data 225 can be performed by the audio mixing electronics 220. With continued reference to FIG. 5, the I2S formatted audio signal 502 is provided to channel 1 (left) amplifier 504 and channel 2 (right) amplifier 506. In some embodiments, the amplifiers 504 and 506 are I2S input amplifiers. The amplifiers 504 and 506 can be mono amplifiers each amplifying and producing a different channel of stereo signal so that the combined output of the amplifiers is a high quality stereo signal.

In some embodiments, the amplifiers 504 and 506 are 3.4 W I2S input mono class D audio amplifiers part number TFA9882, manufactured by NXP Semiconductors, having parameters described in the "TFA9882 product data sheet," available at http://www.nxp.com/documents/data_sheet/TFA9882.pdf, which is incorporated by reference in its entirety. Such audio amplifiers can have low radio frequency (RF) noise susceptibility because they use digital input interface that is insensitive or substantially insensitive to clock jitter. In addition, such audio amplifiers can provide high quality audio performance and high supply voltage ripple rejection. To achieve stereo output, left channel audio is generated by connecting the I2S word select line (I2SWS) to WSL (word select left) input or pin of the left amplifier 504 and by connecting the WSR (word select right) pin of the left amplifier 504 to the power rail (e.g., VDD). Right channel audio is generated by connecting the I2S word select line (I2SWS) to WSR (word select right) pin of the right amplifier 506 and by connecting the WSL (word select left) pin of the right amplifier 506 to the power rail (e.g., VDD). The I2S serial clock line (I2SCLK) is connected to the BCK (bit clock) pin of the amplifiers 504 and 506. The I2S serial data line (I2SDATA) is connected to the DATA input of the amplifiers 504 and 506. In some embodiments, mono mixing or output can be achieved by connecting the I2S word select line (I2SWS) to both WSL and WSR pins of the amplifiers 504 and 506.

In some embodiments, left audio amplifier 504 converts digital I2S audio data into a pulse width modulated (PWM) digital signal. In some embodiments, the PWM digital signal produced by the left audio amplifier 504 corresponds to a digital representation of the analog audio signal. The PWM digital signal is provided to the input path 508 connecting the amplifier 504 to one or more speaker drivers. In some embodiments, the input path 508 can further filter and convert into analog representation the PWM digital signal. The output of the input path 508 can be an amplified analog audio signal for the left channel. In the illustrated embodiment, the input path 508 is connected to a left primary speaker 522 and left tweeter 524. As explained above, the processed audio signal can be a combined audio signal having high frequency mono components and lower frequency stereo components. Lower frequency stereo components can be output or reproduced by the primary speaker 522, while high frequency mono components can be output or reproduced by the tweeter 524. In some embodiments, lower frequency components are removed or filtered out from the audio signal fed to the tweeter 524. Capacitor 521 can be part of high pass filter, such as RC filter, configured to remove lower frequency components from the audio signal fed to the tweeter 524. In the illustrated embodiment, the combined stereo/mono signal is fed to the primary speaker 522 without filtering out the higher frequency mono component of the signal, thereby reducing circuit complexity. Moreover, as indicated previously, in some embodiments including the illustrated embodiment, the primary speakers are capable of reproducing audio at frequencies including some or all of those included in the high frequency mono signal. Thus, this configuration can allow the primary speaker 522 to output higher frequency sound, improving the 360 degree sound effect, among providing other advantages.

In some embodiments, right audio amplifier 506 converts digital I2S audio data into a pulse width modulated (PWM) digital signal. In some embodiments, the PWM digital signal produced by the right audio amplifier 508 corresponds to a digital representation of the analog audio signal. The PWM digital signal is provided to the input path 510 connecting the amplifier 506 to one or more speaker drivers. In some embodiments, the input path 510 can further filter and convert into analog representation the PWM digital signal. The output of the input path 510 can be an amplified analog audio signal for the right channel. In the illustrated embodiment, the input path 510 is connected to a right primary speaker 526 and right tweeter 528. As explained above, the processed audio signal can be a combined audio signal having high frequency mono components and lower frequency stereo components. Lower frequency stereo components can be output or reproduced by the primary speaker 526, while high frequency mono components can be output or reproduced by the tweeter 528. In some embodiments, lower frequency components are removed or filtered out from the audio signal fed to the tweeter 528. Capacitor 523 can be part of high pass filter, such as RC filter, configured to remove lower frequency components from the audio signal fed to the tweeter 528. In the illustrated embodiment, the combined stereo/mono signal is fed to the primary speaker 526 without filtering out the higher frequency mono component of the signal, thereby reducing circuit complexity. Moreover, as indicated previously, in some embodiments including the illustrated embodiment, the primary speakers are capable of reproducing audio at frequencies including some or all of those included in the high frequency mono signal. Thus, this configuration can allow the primary speaker 526 to output higher frequency sound, improving the 360 degree sound effect, among providing other advantages.

In some embodiments, different amplifiers can be used from those described above. One or more of the illustrated and describe components can be omitted or additional components can be used. For example, one or more of the speaker drivers can be omitted or additional speaker drivers can be used.

Speaker Enclosures ("Jackets")

Embodiments of disclosed portable speakers can be enclosed in interchangeable enclosures (or "jackets"), which can protect the speaker from potential damage resulting from moving the speaker. In some embodiments, jackets can be easily attached to the portable speaker and easily detached from the portable speaker. Jackets can provide aesthetic appeal and protect the speaker from damage without negatively affecting the quality of audio output.

Figure 6A:
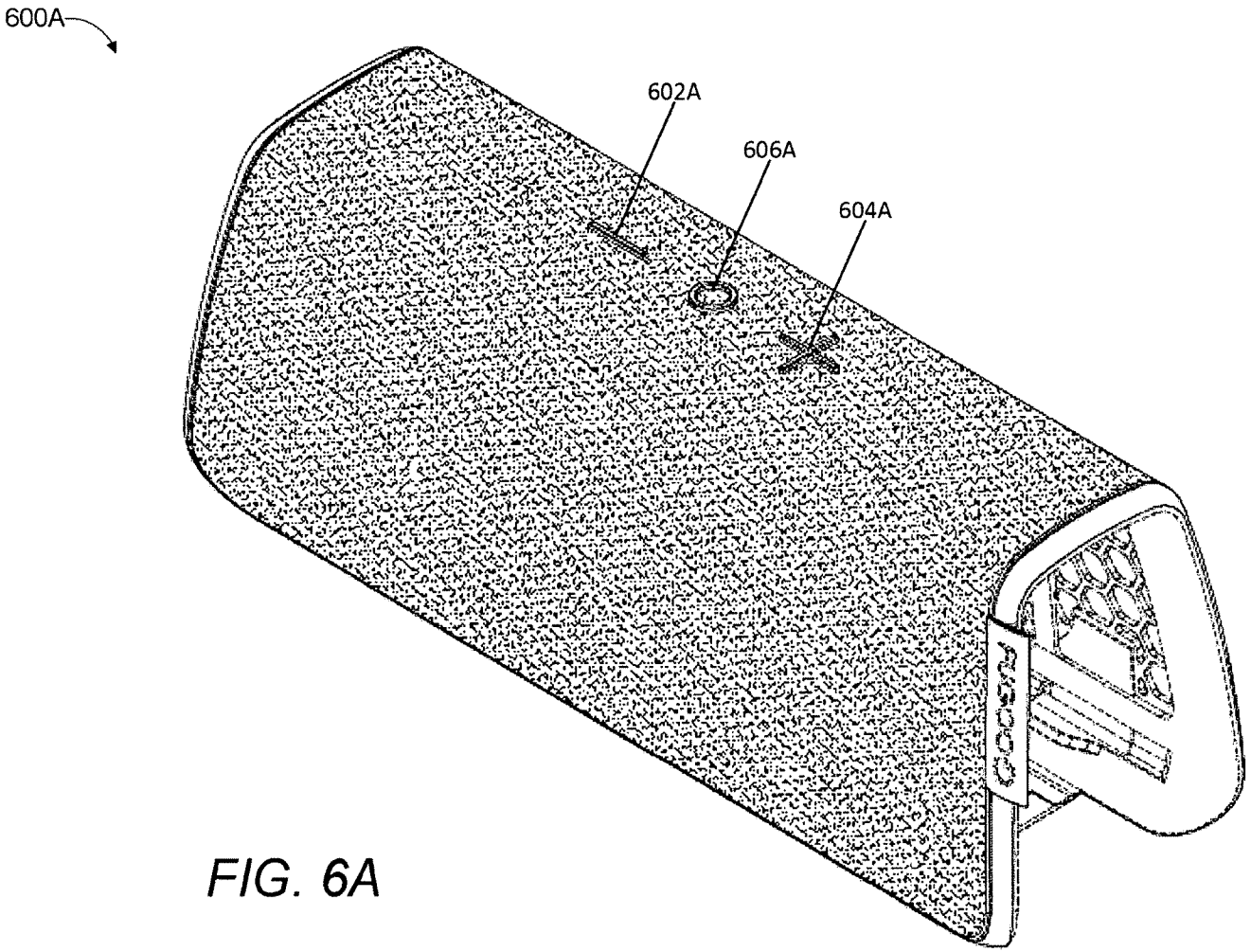
FIGS. 6A-6C illustrate speaker enclosures according to some embodiments.

FIG. 6A illustrates a jacket 600A according to some embodiments. The jacket 600A can be removably attached to the enclosure or housing of the speaker, such as the housing 110. The jacket 600A includes controls 602A and 604A for controlling the volume up down and up, respectively, and control 606A for powering the speaker on/off. The controls 602A, 604A, and 606A can be buttons that are configured to interact with controls 144 positioned on the speaker housing 110. For example, the listener can operate controls 144 via pressing the controls 602A, 604A, and 606A.

Figure 6B:
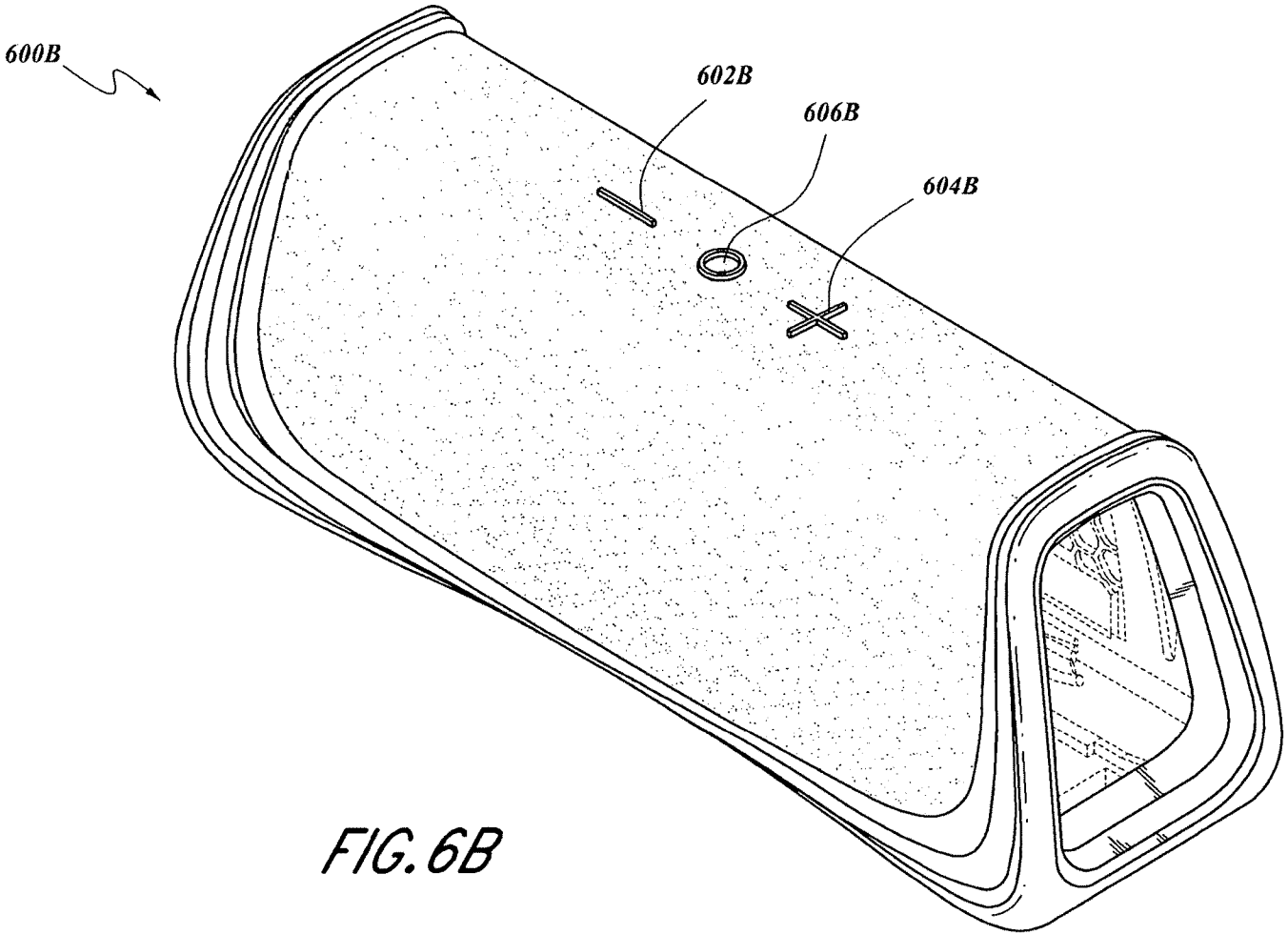

FIG. 6B illustrates a jacket 600B according to some embodiments. The jacket 600B can be removably attached to the enclosure or housing of the speaker, such as the housing 110. The jacket 600B includes controls 602B and 604B for controlling the volume up down and up, respectively, and control 606B for powering the speaker on/off. The controls 602B, 604B, and 606B can be buttons that are configured to interact with controls 144 positioned on the speaker housing 110. For example, the listener can operate controls 144 via pressing the controls 602B, 604B, and 606B. The jacket 600B can fully enclose or substantially fully enclose the speaker on all sides and can be made of waterproof or substantially waterproof material to protect the speaker from water damage. In some embodiments, the jacket 600B can include one or more drain holes and channels to allow for drainage of any water.

Figure 6C:
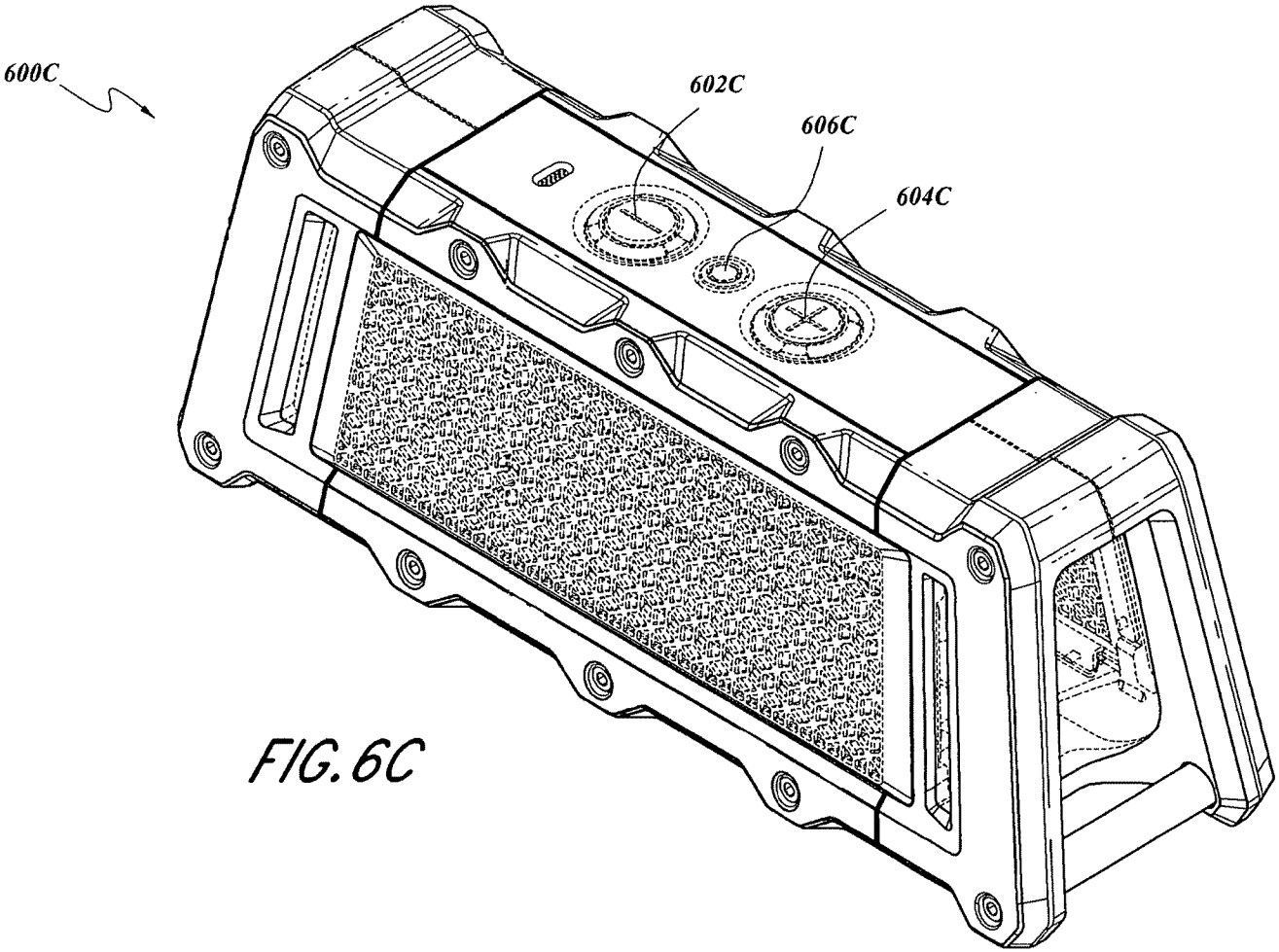

FIG. 6C illustrates a jacket 600C according to some embodiments. The jacket 600C can be removably attached to the enclosure or housing of the speaker, such as the housing 110. The jacket 600C includes controls 602C and 604C for controlling the volume up down and up, respectively, and control 606C for powering the speaker on/off. The controls 602C, 604C, and 606C can be buttons that are configured to interact with controls 144 positioned on the speaker housing 110. For example, the listener can operate controls 144 via pressing the controls 602C, 604C, and 606C. The jacket 600C can be made of robust material, such as thick plastic or alloy, to protect the speaker from damage during outdoor use.

In some embodiments, one or more jackets, such as jackets 600A-600C, can be of any suitable shape to match the shape of the speaker. The jackets can be made of any suitable material or combination of materials. The jackets can include additional controls or can omit one or more of the described controls. The controls can be placed on different surfaces of the jacket and in different places on a surface.

Additional Speaker Systems

Figure 7:
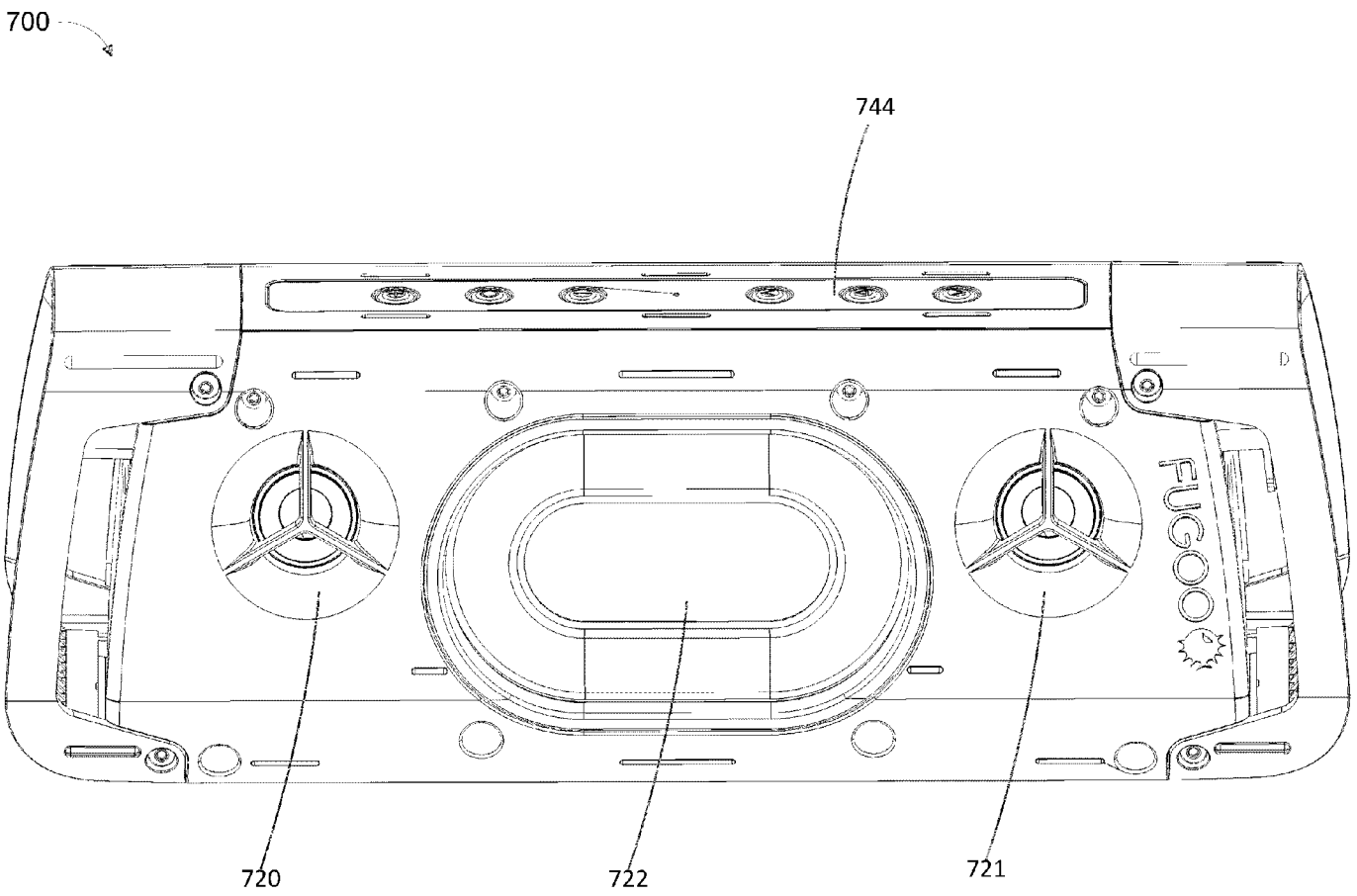
FIG. 7 illustrates another speaker system according to some embodiments.

FIG. 7 illustrates another speaker system 700 according to some embodiments. The speaker 700 is in some respects similar to the speaker 100. The speaker 700 includes drivers 720 and 721, which (like the speaker driver 120) can be tweeters configured to reproduce high frequency audio, such as, audio in the range of about 2 kHz to about 20 kHz (e.g., between about 6-20 kHz, 7-20 kHz, 8-20 kHz, 9-20 kHz, 10-20 kHz, and the like). Speaker drivers 720 and 721 can be configured to reproduce high fidelity audio. In some embodiments, speaker drivers 720 and 721 can be a full-range speakers, mid-range speakers, low frequency speakers, etc. Speaker drivers 720 and 721 are active drivers in the illustrated embodiment. In some embodiments, each of the speaker drivers 720 and 721 can be driven with left and right stereo components. For example, the speaker driver 720 can be driven with left stereo channel and speaker driver 721 can be driven with right stereo channel (or vice versa). In some embodiments, one or both speaker drivers 720 and 721 are not used.

The speaker 700 includes a speaker driver 722, which (like the speaker driver 122) can be a low frequency speaker configured to reproduce low frequency audio or bass, such as, audio in the range of about 20 Hz to about 200 Hz. The speaker driver 722 can be passive. For instance, a passive speaker driver 722 is used, such as, a passive radiator speaker which may or may not include an active driver. In certain embodiments, a different passive driver 722 (e.g., a driver that does not include an actively driven component) is used, such as sealed or ported enclosure, a bass reflex system with one or more ports or vents, one or more reflex ports, and the like. The speaker driver 722 can be configured to reproduce high fidelity audio. In some embodiments, the speaker driver 722 can be a full-range speaker, mid-range speaker, tweeter, etc. In some embodiments, the speaker driver 722 is not used. In some other embodiments, the speaker driver 722 is an actively driven component.

In some embodiments, the speaker 700 includes one or more input devices, such as a microphone, and/or user controls 744. The controls 744 can be power on/off, volume up/down, equalizer, and the like. In some embodiments, additional or different controls and input devices can be used and can be placed on different surfaces of a housing of the speaker 700 in different places on the surfaces. In some embodiments, input devices or controls are not used.

Additional speaker drivers can be enclosed in or otherwise supported by a housing of the speaker 700 and can be facing out on the rear side (not shown). The additional speaker driver can be placed symmetrically or substantially symmetrically with respect to the speaker drivers 720, 721, and 722. The additional speaker driver can have same or substantially same features as the speaker driver 720, 721, and 722 respectively. In some embodiments, one or more of the additional speaker drivers are not used.

Other Variations

Additional embodiments of the disclosed speakers and speaker enclosures are described in the following patent applications, each of which is incorporated by reference in its entirety:

- U.S. patent application Ser. No. 14/586,701, titled "CONFIGURABLE PORTABLE SOUND SYSTEMS WITH INTERCHANGEABLE ENCLOSURES", filed on Dec. 30, 2014.
- U.S. patent application Ser. No. 14/588,803, titled "SPEAKER SYSTEM", filed on even date herewith.
- U.S. Patent Application No. 61/923,554, titled "SPEAKER SYSTEM", filed Jan. 3, 2014.

TERMINOLOGY

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Conjunctions, such as "and," "or" are used interchangeably and are intended to encompass any one element, combination, or entirety of elements to which the conjunction refers.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially.

Systems and modules described herein may comprise software, firmware, hardware, or any combination(s) of software, firmware, or hardware suitable for the purposes described herein. Various disclosed and illustrated modules may be implemented as software and/or firmware on a logic circuitry, processor, ASIC/FPGA, or dedicated hardware. Software and other modules may reside on servers, workstations, personal computers, computerized tablets, PDAs, and other devices suitable for the purposes described herein. Software and other modules may be accessible via local memory, via a network, via a browser, or via other means suitable for the purposes described herein. User interface components described herein may comprise buttons, knobs, switches, touchscreen interfaces, and other suitable interfaces.

Further, the processing of the various components of the illustrated systems can be distributed across multiple logic circuits, processors, machines, networks, and other computing resources. In addition, two or more components of a system can be combined into fewer components. Various components of the illustrated systems can be implemented in one or more virtual machines, rather than in dedicated computer hardware systems. Moreover, in some embodiments the connections between the components shown represent possible paths of data flow, rather than actual connections between hardware. While some examples of possible connections are shown, any of the subset of the components shown can communicate with any other subset of components in various implementations.

Embodiments are also described above with reference to flow chart illustrations and/or block diagrams of methods, apparatus (systems) and computer program products. The actual steps taken in the disclosed processes, such as the process illustrated in FIG. 4, may differ from those disclosed or illustrated. Depending on the embodiment, certain of the steps described above may be removed, others may be added. In addition, each block of the flow chart illustrations and/or block diagrams, and combinations of blocks in the flow chart illustrations and/or block diagrams, may be implemented by computer program instructions. Such instructions may be provided to a processor of a general purpose computer, special purpose computer, or other programmable data processing apparatus to produce a machine, such that the instructions, which execute via the processor of the computer or other programmable data processing apparatus, create means for implementing the acts specified in the flow chart and/or block diagram block or blocks.

These computer program instructions may also be stored in a computer-readable memory that can direct a computer or other programmable data processing apparatus to operate in a particular manner, such that the instructions stored in the computer-readable memory produce an article of manufacture including instruction means which implement the acts specified in the flow chart and/or block diagram block or blocks. The computer program instructions may also be loaded onto a computer or other programmable data processing apparatus to cause a series of operations to be performed on the computer or other programmable apparatus to produce a computer implemented process such that the instructions which execute on the computer or other programmable apparatus provide steps for implementing the acts specified in the flow chart and/or block diagram block or blocks.

While certain embodiments have been described, these embodiments have been presented by way of example only, and are not intended to limit the scope of the disclosure. Indeed, the novel methods and systems described herein may be embodied in a variety of other forms; furthermore, various omissions, substitutions and changes in the form of the described methods and systems may be made without departing from the spirit of the disclosure. The accompanying claims and their equivalents are intended to cover such forms or modifications as would fall within the scope and spirit of the disclosure.

What is claimed is:

1. A portable speaker system comprising:

a housing comprising first and second opposing ends, a bottom side, and first and second opposing sides, the first and second ends defining a width of the housing, the bottom, first, and second sides each extending along a length of the housing between the first end and the second end, the length greater than the width;

first and second tweeters supported by the housing, the first tweeter arranged on the first side and the second tweeter arranged on the second side;

first and second primary speakers supported by the housing, the first primary speaker arranged on the first end and the second primary speaker arranged on the second end;

first and second passive radiator speakers supported by the housing, wherein the first passive radiator speaker is arranged on the first side along with the first tweeter and the second passive radiator speaker is arranged on the second side along with the second tweeter;

an input interface configured to receive a stereo audio signal from an audio source, the stereo audio signal comprising left and right channels; and audio mixing electronics disposed within the housing and configured to receive the stereo audio signal from the input interface, the audio mixing electronics comprising:

a mixer stage configured to:

process the stereo audio signal to obtain a high frequency stereo component and a lower frequency stereo component; and obtain a mono component by combining left and right channels of the high frequency stereo component; and a driver stage comprising one or more audio amplifier circuits, the driver stage configured to:

output at least the mono component to the first and second tweeters and at least the lower frequency stereo component to the first and second primary speakers, such that the first primary speaker outputs a left channel of the lower frequency stereo component, the second primary speaker outputs the right channel of the lower frequency stereo component, and the first and second tweeters both output the mono component.

2. The portable speaker system of claim 1, wherein the input interface is configured to wirelessly receive the stereo audio signal from the audio source.

3. The portable speaker system of claim 2, wherein the input interface is configured to wirelessly receive the stereo audio signal from the audio source via a Bluetooth protocol.

4. The portable speaker system of claim 1, wherein the audio mixing electronics is configured to obtain the mono component by summing the left and right channels of the high frequency stereo component.

5. The portable speaker system of claim 1, wherein the high frequency stereo component comprises frequencies higher than about 8 kHz.

6. The portable speaker system of claim 1, wherein the high frequency stereo component comprises frequencies higher than about 10 kHz.

7. The portable speaker system of claim 1, wherein the audio mixing electronics is further configured to combine the mono component and the lower frequency stereo component into a combined audio signal, and the driver stage is further configured to output the combined audio signal to the first and second tweeters and the first and second primary speakers.

8. The portable speaker system of claim 7, wherein the combined audio signal comprises the mono component on the right and left channels.

9. The portable speaker system of claim 1, wherein the one or more audio amplifier circuits receives input data via an Inter-IC Sound (I2S) bus.

10. The portable speaker system of claim 9, wherein the one or more audio amplifier circuits comprise first and second mono amplifiers.

11. The portable speaker system of claim 10, wherein the first and second mono amplifiers comprise mono class-D audio amplifiers.

12. The portable speaker system of claim 1, wherein the audio mixing electronics comprises a digital signal processor (DSP).

13. A portable speaker system comprising:

a housing comprising a plurality of speakers, the plurality of speakers comprising:

first and second primary speakers arranged on opposing ends of the housing, the first primary speaker arranged on a first end of the opposing ends and the second primary speaker arranged on a second end of the opposing ends;

first and second tweeters arranged on opposing sides of the housing, the first tweeter arranged on a first side of the opposing sides and the second tweeter arranged on a second side of the opposing sides; and first and second low frequency speakers arranged on the opposing sides of the housing, the first low frequency speaker arranged on the first side, and the second low frequency speaker arranged on the second side; and the portable speaker system further comprising electronics disposed within the housing, the electronics configured to receive a stereo audio signal comprising left and right channels, the electronics further configured to:

process the stereo audio signal to obtain a high frequency stereo component and a lower frequency stereo component;

combine the left and right channels of the high frequency stereo component to obtain a mono component;

output the mono component to at least the first and second tweeters; and output the lower frequency stereo component to at least the first and second primary speakers.

14. The portable speaker system of claim 13, wherein first and second low frequency speakers comprise first and second passive radiator speakers.

15. The portable speaker system of claim 13, wherein the electronics are further configured to sum the left and right channels of the high frequency stereo component to obtain the mono component.

16. The portable speaker system of claim 1, wherein the driver stage is configured to output only the mono component and not the lower frequency stereo component to the first and second tweeters.

17. The portable speaker system of claim 16, wherein the driver stage is configured to output only the lower frequency stereo component and not the mono component to the first and second primary speakers.

18. The portable speaker system of claim 13, wherein the electronics are configured to output both the mono component and the lower frequency stereo component to the first and second tweeters and to output both the mono component and the lower frequency stereo component to the first and second primary speakers.

19. The portable speaker system of claim 13, wherein the electronics are configured to output only the mono component and not the lower frequency stereo component to the first and second tweeters.

20. The portable speaker system of claim 19, wherein the electronics are configured to output only the lower frequency stereo component and not the mono component to the first and second primary speakers.

* * * * *